US011744368B2

(12) United States Patent
Li et al.

(10) Patent No.: US 11,744,368 B2
(45) Date of Patent: Sep. 5, 2023

(54) MECHANICAL EXTENSION APPARATUS FOR RECLINING SEAT HAVING EXTENDABLE CHAIR UNIT

(71) Applicant: REMACRO TECHNOLOGY CO., LTD., Jiangsu (CN)

(72) Inventors: Xiaohong Li, Jiangsu (CN); Wei Liu, Jiangsu (KR); Gang Song, Jiangsu (CN); Yuankun Li, Jiangsu (KR)

(73) Assignee: Remacro Technology Co., Ltd., Jiangsu (CN)

( * ) Notice: Subject to any disclaimer, the term of this patent is extended or adjusted under 35 U.S.C. 154(b) by 6 days.

(21) Appl. No.: 17/513,863

(22) Filed: Oct. 28, 2021

(65) Prior Publication Data

US 2022/0361674 A1 Nov. 17, 2022

Related U.S. Application Data

(63) Continuation of application No. PCT/CN2021/119049, filed on Sep. 17, 2021.

(30) Foreign Application Priority Data

May 17, 2021 (CN) ..... 202110534473.X
Jun. 10, 2021 (CN) ..... 202110651109.1

(51) Int. Cl.
*A47C 1/035* (2006.01)
*G05G 11/00* (2006.01)
*A47C 1/0355* (2013.01)

(52) U.S. Cl.
CPC ..... *A47C 1/0355* (2013.01); *A47C 1/0352* (2013.01)

(58) Field of Classification Search
CPC ..... B60B 2/0232; B60B 2/002; B60B 2/34; A47C 1/031; A47C 1/035; A47C 1/0242; A47C 1/034
See application file for complete search history.

(56) References Cited

U.S. PATENT DOCUMENTS 8,419,122 B2 * 4/2013 Lawson ..... A47C 1/035 297/259.2
8,696,054 B2 * 4/2014 Crum ..... A47C 1/0355 297/85 M
9,241,571 B2 * 1/2016 Robertson ..... A47C 1/03294
10,405,660 B2 * 9/2019 Robertson ..... A47C 7/54
2011/0181094 A1 * 7/2011 Lawson ..... A47C 1/035 297/85 R (Continued)

*Primary Examiner* — Shin H Kim
(74) *Attorney, Agent, or Firm* — Arch & Lake LLP

(57) ABSTRACT

The present disclosure relates to a mechanical extension apparatus for an extendable chair unit and a chair unit including such mechanical extension apparatus. The mechanical extension apparatus includes: a reclining apparatus that include multiple links attached to the seat, the backrest and the footrest of the extendable seat, and such reclining apparatus is configured to convert the extendable seat between a sitting position, a TV position, and a lying position. The mechanical extension apparatus also includes an actuator that is attached to the reclining apparatus, and the actuator is configured to electronically convert the extendable seat between the sitting position and the TV position; and the reclining apparatus is configured to convert the extendable seat between the TV position and the lying position by non-electric actuation.

18 Claims, 19 Drawing Sheets

(56) References Cited

U.S. PATENT DOCUMENTS

| | | | | |
|---|---|---|---|---|
| 2012/0193946 | A1* | 8/2012 | Robertson | A47C 1/035<br>5/613 |
| 2012/0299363 | A1* | 11/2012 | Crum | A47C 1/0352<br>297/85 M |
| 2016/0120315 | A1* | 5/2016 | Robertson | A47C 7/50<br>297/285 |

* cited by examiner

MECHANICAL EXTENSION APPARATUS FOR RECLINING SEAT HAVING EXTENDABLE CHAIR UNIT

CROSS-REFERENCE TO RELATED APPLICATIONS

The present application is based on and claims the priority to the PCT International Application No. PCT/CN2021/119049, filed on Sep. 17, 2021, the Chinese Patent Application No. 202110534473.X, filed on May 17, 2021, and the Chinese Patent Application No. 202110651109.1, filed on Jun. 10, 2021, the entire content of all of which is hereby incorporated by reference for all purposes.

TECHNICAL FIELD

The disclosure relates to a mechanical extension apparatus for an extendable chair unit and a chair unit including the mechanical extension apparatus.

BACKGROUND

A variety of reclining and extendable seating units, such as rocking chairs, gliding chairs, and sofas with gliding and rocking functions, are well accepted in the consumer market. Such seating units usually include a base for supporting the seat on the ground, and usually can convert between multiple positions, such as an upright sitting position, a fully reclined position, etc. The conversion between difference positions of the seating units may be controlled manually by the user in a non-electric way, or the conversion may be controlled in an electric manner.

SUMMARY

The present disclosure provides a mechanical extension apparatus for an extendable seating unit, and an extendable chair unit.

The first aspect of the present disclosure provides a mechanical extension apparatus for an extendable chair unit with a seat, a backrest and a footrest. The mechanical extension apparatus may include: a reclining apparatus comprising multiple links attached to the seat, the backrest and the footrest of the extendable seat, where the reclining apparatus is configured to convert the extendable seat between a sitting position, a TV position, and a lying position, and where, in the sitting position, the backrest is substantially upright and the footrest is folded below the seat; in the TV position, the backrest is substantially upright and the footrest is substantially horizontally disposed in front of the seat; and in the lying position, an angle between the seat and the backrest is generally larger than the angle between the seat and the backrest in the TV position; and an actuator that is attached to the reclining apparatus, where the actuator is configured to electronically convert the extendable seat between the sitting position and the TV position; and where the reclining apparatus is configured to convert the extendable seat between the TV position and the lying position by non-electric actuation.

In the second aspect of the present disclosure, an extendable seat is provided, and the extendable seat includes: a base; a seat disposed on the base; a backrest disposed on a back side of the seat; a footrest disposed on a front side of the seat; and a mechanical extension apparatus as described in the first aspect of the present disclosure.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples and descriptions of the present disclosure are used to explain the present disclosure, and do not constitute an improper limitation of the present disclosure.

DETAILED DESCRIPTION

Figure 1A:
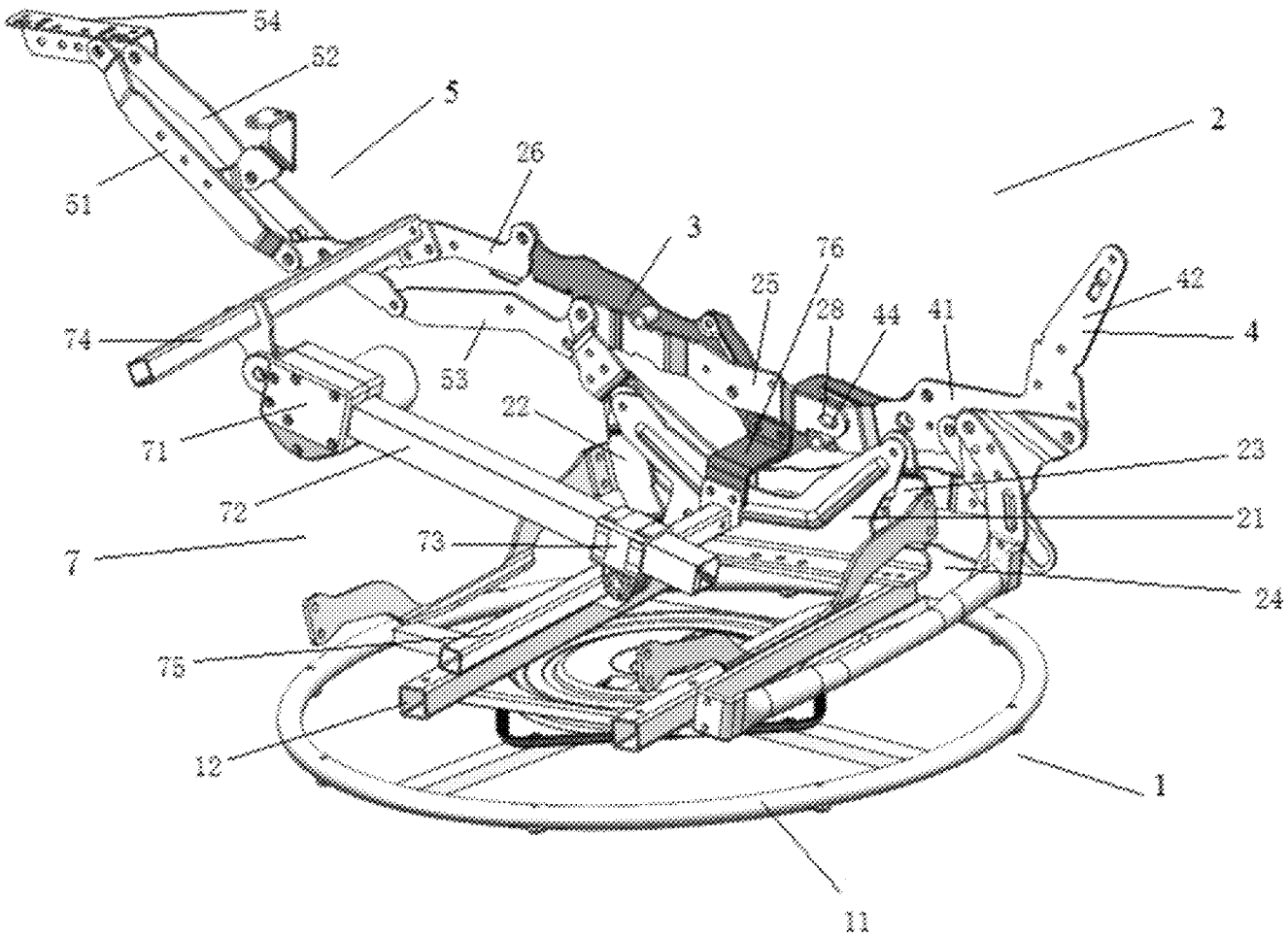
FIG. 1*a* shows a perspective view of a mechanical extension apparatus of a seat unit according to one or more examples of the present disclosure.

The present disclosure is described with reference to examples and corresponding drawings. The described examples are only part but not all of the examples of the present disclosure. Based on the examples in the present disclosure, all other examples obtained by those ordinary skilled in the art without any inventive work belong to the protection scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The description of numerals used in this disclosure may include:

1 Base
11 Circular bracket
12 Fixing bracket
13 Ground bracket
2 Reclining apparatus
21 Swing base plate
21*a* Seat bracket
22 Front swing rod
22*a* Backrest bracket
221 Horizontal section
222 Vertical section
23 Rear swing rod
23*a* Leg extension unit
230 Front connector
231 First foot rod
232 Second foot rod
233 Third foot rod
234 Foot support plate
24 Transmission link
24*a* Linkage device
241 Backrest connector
242 Linkage link
243 Rear connector
25 Pull link
25*a* Swing limit mechanism
251 First limit member
251*a* First limit bush
252 Second limit member
252*a* Second limit bush
253 Chute limit member
253*a* Limit chute
254 Limit link
26 Front connector
27 Rear connector
28 Long hole
29 Rocking base plate
3 Seat bracket
3*a* Support assembly
31 Spring member
31*a* Swing base plate
31' Rocking base plate
32 Front swing rod
33 Rear swing rod
34 Transmission link
341 First sub-piece of transmission link
342 Second sub-piece of transmission link
35 Support link
36 First auxiliary link
37 Second auxiliary link
37*a* Auxiliary bush
4 Backrest bracket
4*a* Electric actuation unit
41 Horizontal section
42 Vertical section
43 Backrest connector
44 Pin
41*a* Motor head
42*a* Motor slide rail
43*a* Motor slider
44*a* Front crossbar
45 Rear crossbar
46 Intermediate connector
5 Leg extension unit
51 First foot rod
52 Second foot rod
53 Third foot rod
55 Footrest support plate
6 Swing limit mechanism
61 First limit member
62 First limit bush
63 Second limit member
64 Second limit bush
65 Chute limit member
66 Swing limit chute
7 Electric actuation unit
71 Motor head
72 Motor slide rail
73 Motor slider
74 Front crossbar
75 Rear crossbar
76 Middle connector
8 Backrest locking mechanism
81 Chute connector
82 Backrest connector chute
83 Mounting member
84 Locking member
9 Pneumatic spring
A First pivot point
B Second pivot point
C Third pivot point
D Fourth pivot point
E Fifth pivot point
F Sixth pivot point
G Seventh pivot point
H Backrest pivot point The chair unit usually has a base, a backrest, a footrest, a seat, and a reclining apparatus. The chair unit can be converted among different positions, such as a sitting position, a TV position, and a lying position. In the sitting position, the backrest of the chair is generally vertically and upright disposed, and the seat is generally horizontally disposed. In the intermediate TV position, the footrest is generally horizontally disposed in front of the seat, and the backrest and the seat substantially maintain the same relationship as they have in the sitting position. In the lying position, the backrest of the chair is fully reclined, and the footrest remains generally horizontally in front of the seat, same as in the TV position. Conversion among above-mentioned positions of chair unit may be performed by the operation of the user manually, or performed automatically by an electric manner.

In the upright sitting position, the seat of the chair is generally horizontally disposed, and the angle between the seat and the backrest may be about 120-130 degrees. While in the fully reclined position, the backrest reclined away from the seat and the footrest, and the angle between the backrest and the horizontally disposed seat may be around 150-160 degrees.

Sometimes, the chair unit has both a manual operating system and an electric operating system. Both of them may be provided with a switching element for switching back and forth between the manual operating system and the electric operating system, such as a switch handle, or a switch key. When the user wants to switch from the manual operating system to the electric operating system or from the electric operating system to the manual operating system, the user must, for example, pull the switch handle to complete the activation of the other operating system. The structure of such design is complicated, which brings a high risk of failure and high manufacturing and maintenance costs.

Also, some other chair units generally cannot meet comfort requirements of users. For example, the user needs to effortfully perform the above-mentioned posture transformation by manual operation, or too many postures are set in advance thus the user has to go through a long transformation process before the desired seat posture is obtained finally. Obviously, this also leads to a complex structure of the chair unit, which leads to a high risk of failure and high manufacturing and maintenance costs.

Firstly, an example of a mechanical extension apparatus for an extendable chair unit is exemplarily shown according to FIG. 1*a*. The mechanical extension apparatus comprises: a base 1, a reclining apparatus 2, where the reclining apparatus comprises a seat bracket 3, a backrest bracket 4, a leg extension unit 5 with a footrest support plate 55, and an electric actuation unit 7.

The base 1 may be designed as a circular bracket 11 supported on the ground as shown in FIG. 1*a*. A fixing bracket 12 comprising a set of parallel extending support rods is rotatably connected to the circular support.

Figure 1B:
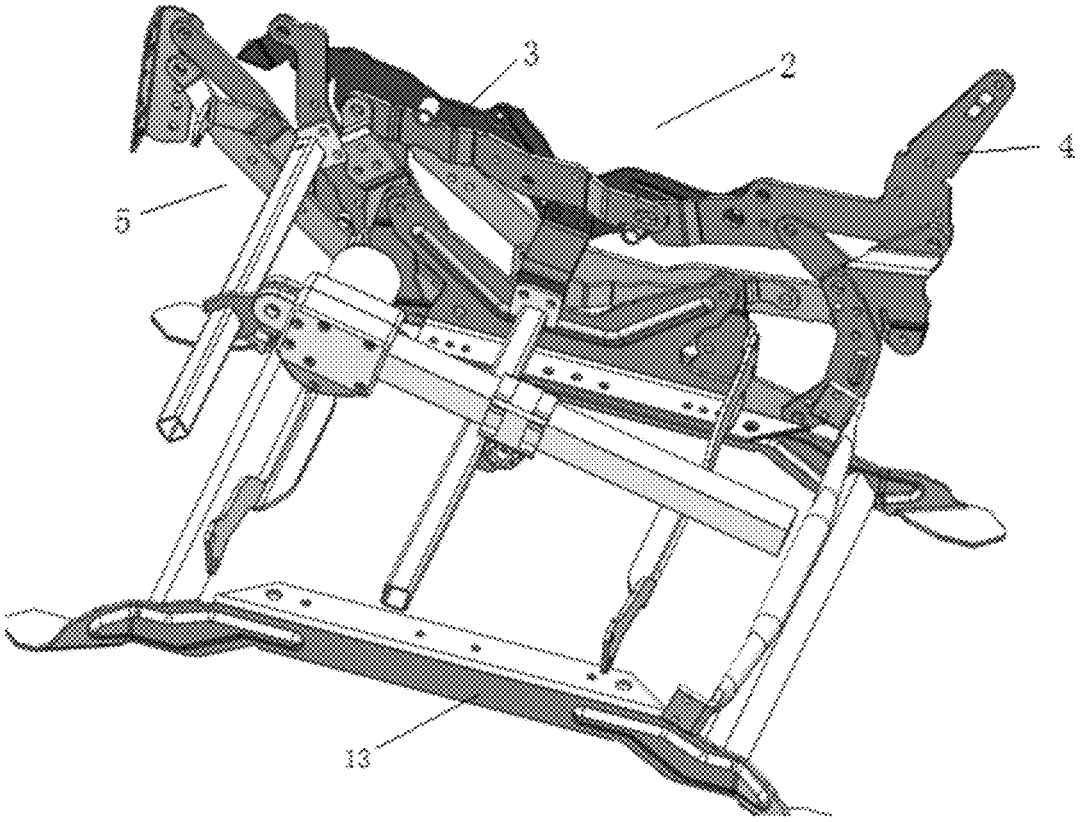
FIG. 1*b* shows a perspective view of a mechanical extension apparatus of a seat unit according to one or more examples of the present disclosure.

Alternatively, in other examples, the base 1 may also be configured as a set of parallel extending ground brackets 13 directly supported on the ground as shown in FIG. 1*b*.

Above the base, specifically in the example shown in FIG. 1*a*, a reclining apparatus 2 is fixedly connected to the fixing bracket 12. The reclining apparatus is arranged mirror-symmetrically on the left and right sides with respective to the longitudinal direction of the chair unit. For the sake of brevity, only a half of the reclining apparatus is shown and specifically explained. The reclining apparatus 2 includes a multi-link mechanism. The multi-link mechanism comprises a swing base plate 21, a front swing rod 22, a rear swing rod 23, and a transmission connecting rod 24, where a bottom part of the swing base plate 21 is fixedly connected to the fixed bracket of the base, a front end of the swing base plate 21 is pivotally connected with a top end of the front swing rod 22, a rear end of a top part of the swing base plate 21 is pivotally connected with a top end of the rear swing rod 23, and a lower end of the front swing rod 22 and a lower end of the rear swing rod 23 are pivotally connected to the longitudinally extending transmission link 24, respectively.

Figure 2:
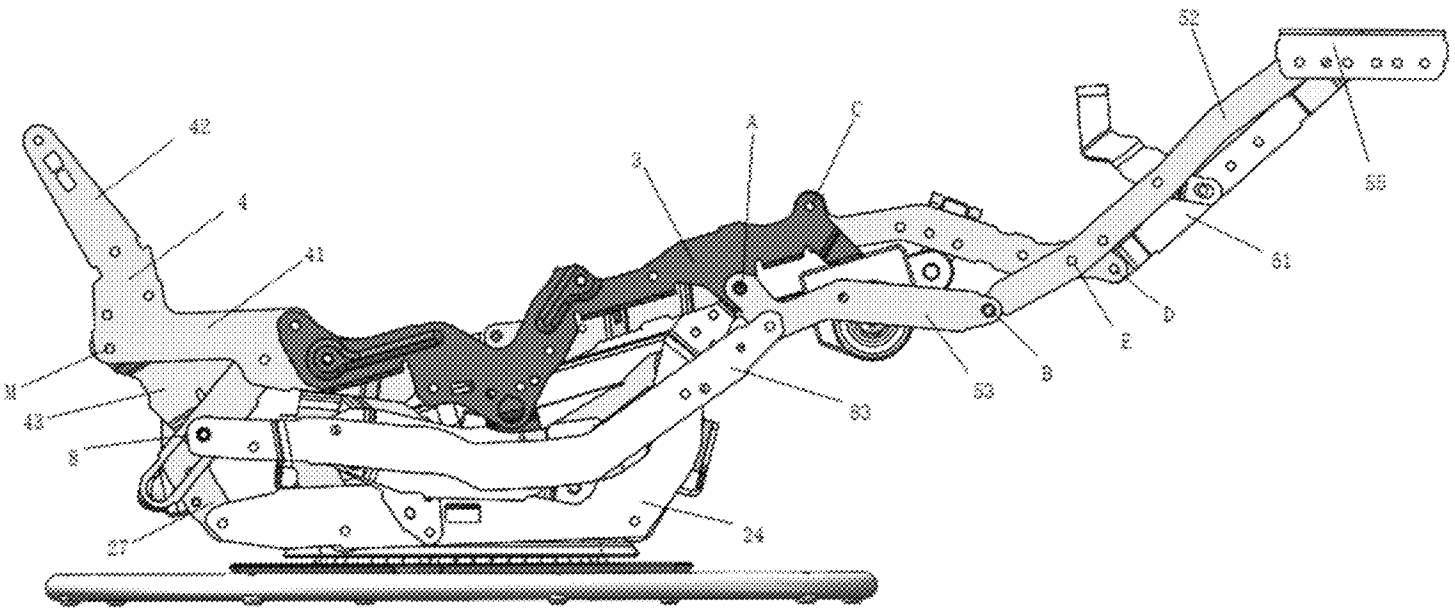
FIG. 2 shows a side view of the mechanical extension of the seat unit shown in FIG. 1*a,* where the seat unit is in a TV position.

As shown in FIG. 2, the leg extension unit 5 comprises a plurality of mutually pivotally connected links, where a rear end of the third foot rod 53 is pivotally connected to the seat bracket 3 at a first pivot point A, a front end of the third foot rod 53 is pivotally connected to a rear end of the second foot rod 52 through a second pivot point B, a rear end of a front connector 26 is pivotally connected to a front end of the seat bracket 3 through a third pivot point C, a front end of a front connector 26 is pivotally connected to a rear end of the first foot rod through a fourth pivot point D, front ends of the first foot rod 51 and the second foot rod 52 are pivotally connected to a footrest support plate 55 respectively, and the second foot rod 52 is also pivotally connected to the front connector 26 at a fifth pivot point E.

A rear end of the transmission link 24 is pivotally connected to a lower end of the upwardly extending rear connector 27, and a top end of the rear connector 27 is pivotally connected to the backrest pivot point M on the backrest bracket 4 through the backrest connector 43. In this example, the backrest bracket 4 is configured to have, in the sitting position, a horizontal section 41 extending substantially horizontally and a vertical section 42 extending substantially vertically. The backrest pivot point M is located at the transition point of the horizontal section and the vertical section. The seat bracket 3 may be pivotally connected to a middle part of the horizontal section 41 of the backrest bracket 4. A rear end of a pull link 25 is pivotally connected the bracket 4 at a sixth pivot point F between the seat bracket 3 and the horizontal section 41. A front end of the pull link 25 is pivotally connected to a front end of the transmission link 24. The pull link 25 is pivotally connected to the seat bracket 3 through a seventh pivot point G in a middle part.

In one example, a pin 44 is provided a front end of the horizontal section 41 of the backrest bracket. A long hole 28 is provided on the rear end of the pull link 25. The pin 44 is movably fitted in the long hole 28, so that the backrest bracket and the pull link are pivotally connected with certain degrees of freedom in the longitudinal direction. As an alternative, a reverse design not shown in the figures may also be adopted, that is, a long hole is provided on the front end of the horizontal section of the backrest bracket, and the pin is provided on the rear end of the pull link. With the pin being movably fitted in the long hole, the front end of the horizontal section 41 of the backrest bracket is connected with the rear end of the pull link 25.

Figure 3A:
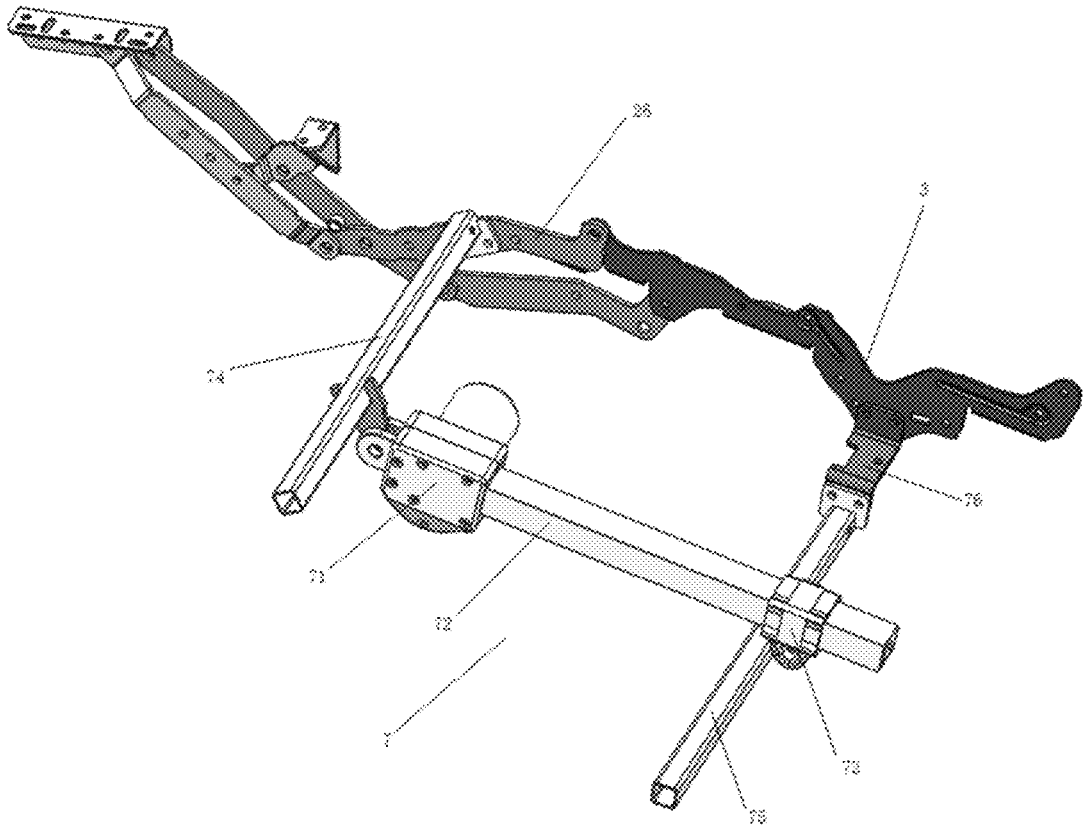
FIG. 3*a* shows a separate view of the electric actuation unit of the mechanical extension of the seat unit shown in FIG. 1*a;*

As shown in FIG. 3*a*, the chair unit has an electric actuation unit 7. In this example, the electric actuation unit is a linear motor unit, comprising a motor head 71, a motor slide rail connected to the motor head 71, and a motor slider 73 slidable relative to the motor slide rail 72, where the motor head 71 is pivotally connected to a front crossbar 74 fixedly connected to a front connector 26 of the leg extension unit 5, and the motor slider 73 is pivotally connected to a rear crossbar 75, and two ends of the rear crossbar 75 are fixedly connected to a middle part of the seat bracket 3 through an intermediate connector 76, respectively. Thereby, when the motor head 71 moves longitudinally back and forth relative to the motor slider 73 along the motor slide rail 72, the front crossbar 74 drives the leg extension unit 5 to extend forward or fold backward through the front connector 26.

When the leg extension unit 5 is fully extended, the motor head 71 reaches its forward limit position. Since the rear crossbar 75 is connected to the seat bracket 3, the longitudinal driving force is transmitted to the seat bracket and unable to push the backrest bracket 4 to flip backward around the backrest pivot point M. As a result, the chair unit can only be converted between the sitting position and the TV position under the drive of the electric actuation unit.

Figure 3B:
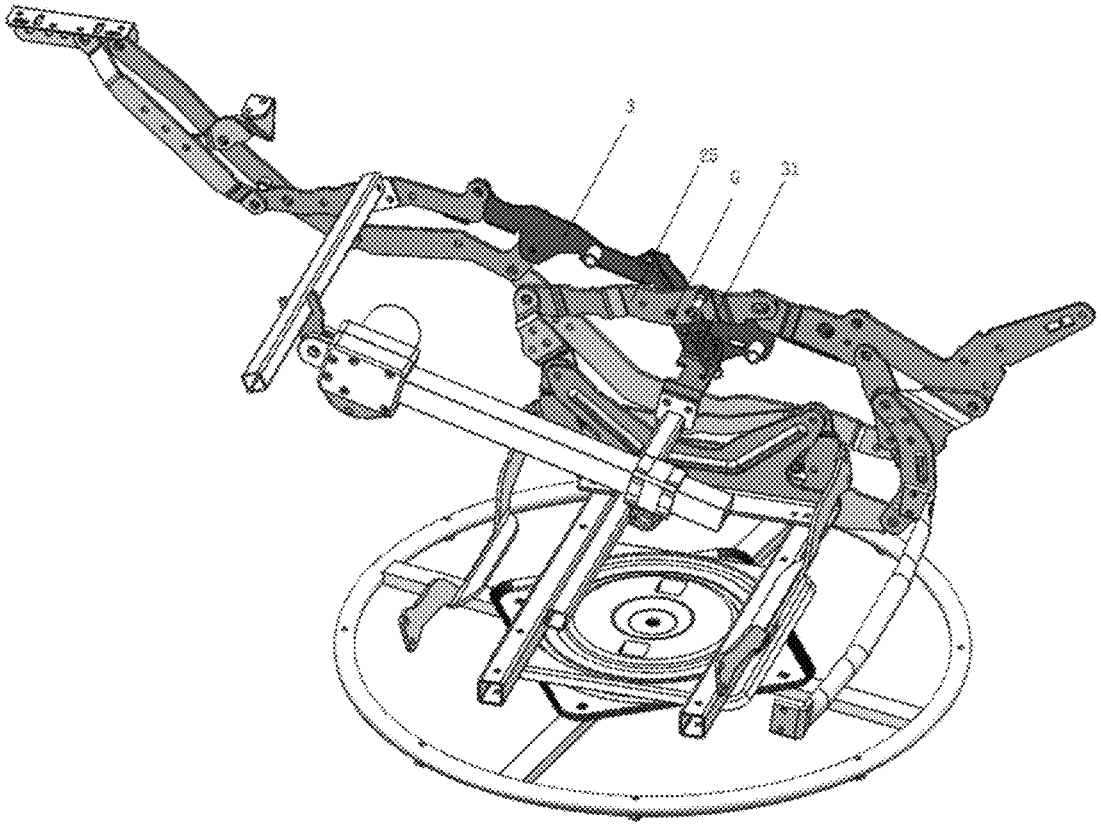
FIG. 3*b* shows an alternative example of the mechanical extension apparatus according to the present disclosure.

In one example shown in FIG. 3*b*, the reclining apparatus 2 further comprises a spring member 31 for tightening the pull link 25 and the seat bracket 3 to each other. The spring member may exert a downward pulling force when the backrest bracket 4 is flipped forward, so as to assist the backrest to restore to the sitting position. Optionally, the action point of the pulling force exerted on the pull link 25 by the spring member is located behind a seventh pivot point G between the pull link 25 and the seat bracket 3.

Figure 4A:
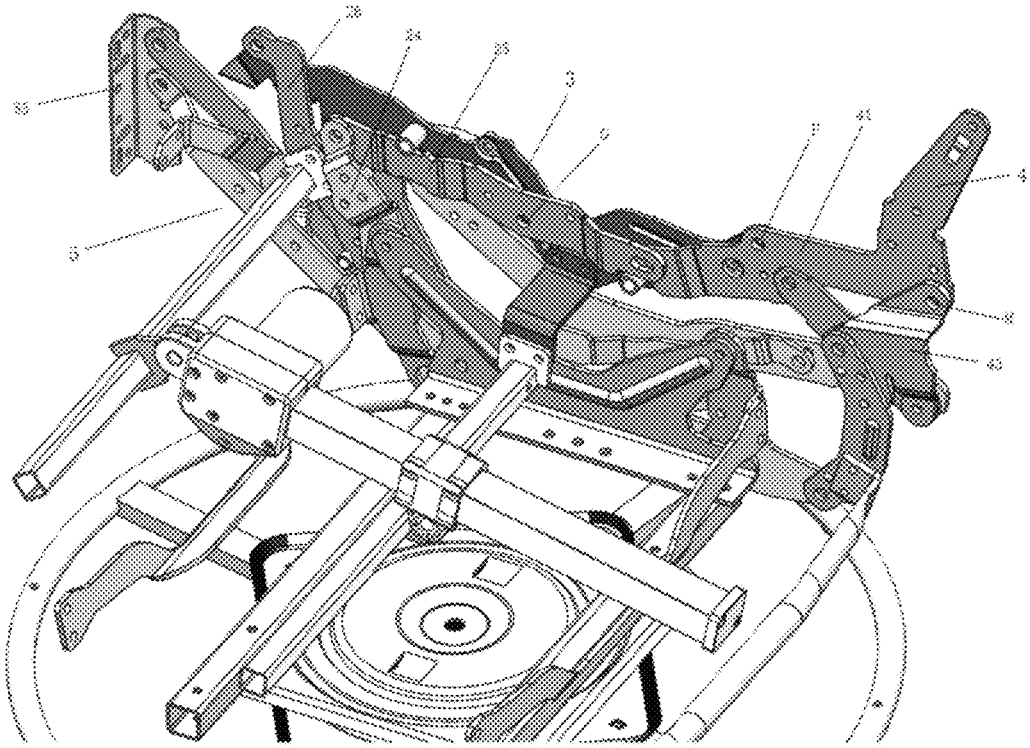
FIGS. 4*a* to 4*c* show perspective views of the seat unit shown in FIG. 1*a* in the sitting position, the TV position, and the lying position, respectively.
Figure 4B:
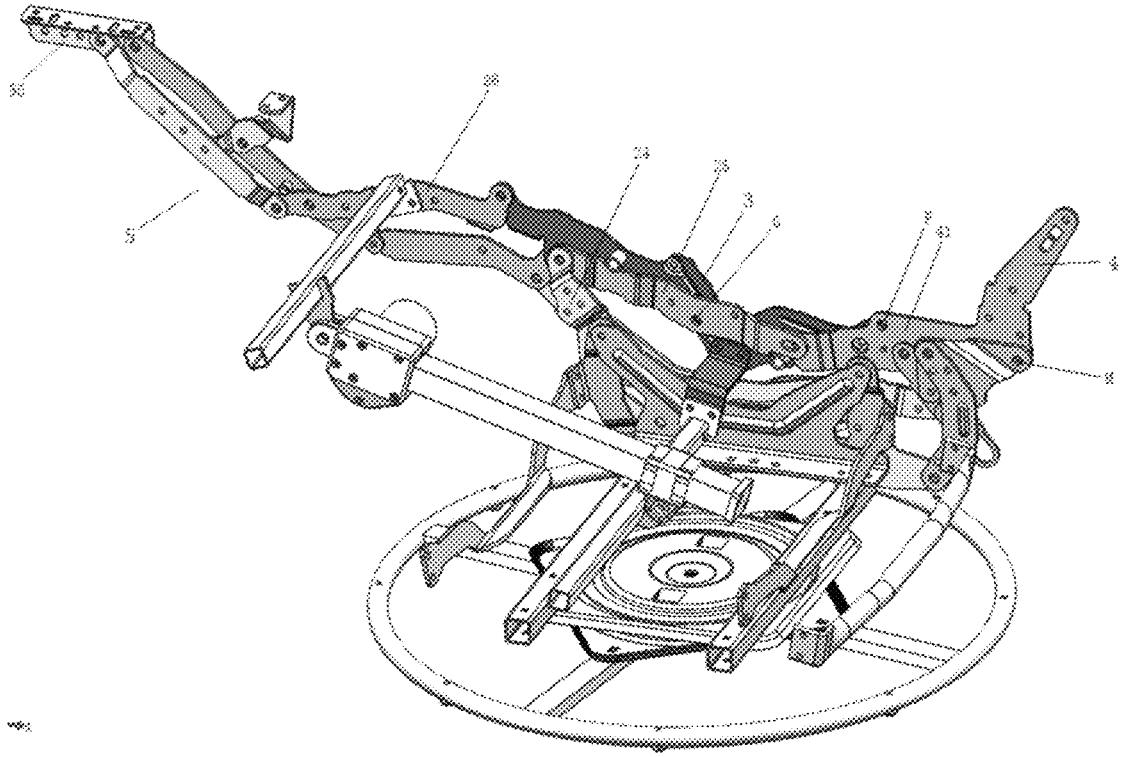
Figure 4C:
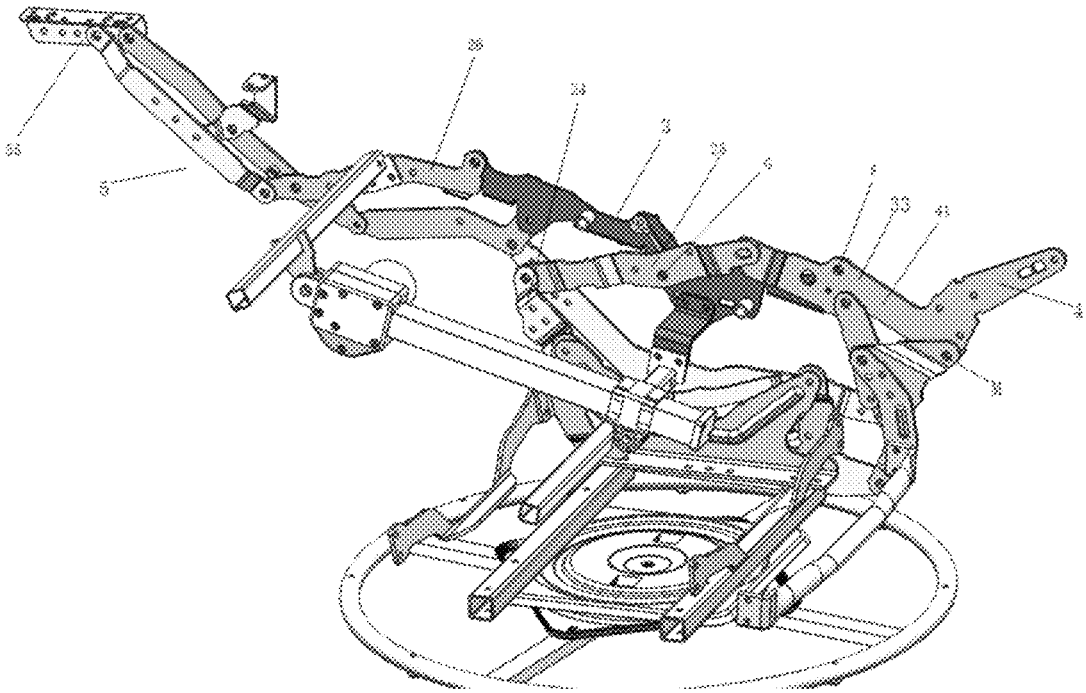

The working mode of the chair unit conversion among the sitting position, the TV position and the lying position is explained below with reference to FIGS. 4*a* to 4*c*.

In the sitting position shown in FIG. 4*a*, the backrest bracket 4 is oriented substantially vertically; the seat bracket 3 is substantially oriented horizontally; the footrest support plate 55 is substantially oriented vertically; and the leg extension unit 5 is completely folded below the seat bracket 3. In the TV position shown in FIG. 4*b*, the leg extension unit 5 is fully extended forward, and the relative positions of the seat bracket 3 and the backrest bracket 4 remain substantially unchanged. In the lying position shown in FIG. 4*c*, the legs extension unit 5 is kept completely extended forward, and the backrest bracket 4 is completely tilted backward.

When the motor head 71 runs in a forward direction, the position of the seat bracket 3 remains substantially unchanged in the longitudinal direction due to the gravity of the user. The motor head 71 moves forward relative to the motor slider 73 along the motor slide rail 72, causing the distance between the motor head 71 and the motor slider 73 to increase, so that the front crossbar 74 drives the front connector 26 to rise forward, thereby enabling the leg extension unit to fully extend from the folded sitting position shown in FIG. 4*a* to the TV position shown in FIG. 4*b*. Starting from the TV position, when the user leans back on the backrest forcibly, the backrest bracket 4 is tilted backwards around the backrest pivot point M through the backward pressure, which in turn drives the pull link 25 to tilt up. At the same time, a rear end of the seat bracket 3 pivotally connected to a middle part of the horizontal section 41 of the backrest bracket 4 is driven to rise slightly, but the positions of the seat bracket 3 and the leg extension unit 5 remain substantially unchanged. When the backrest bracket 4 is tilted backward to the maximum extent, the lying position shown in FIG. 4*c* is reached.

When the user gets up, the force exerted on the backrest bracket 4 is withdrawn, so that the backrest bracket 4 automatically pivots forward around a backrest pivot point M under the driving of the pull link 25, thereby restoring from the lying position to the TV position. Starting from the TV position, if the motor head 71 runs in a reverse direction, the motor head 71 moves along the motor slide rail 72 toward the motor slider 73, so that the distance between the motor head 71 and the motor slider 73 decreases, thereby the leg extension unit 5 is folded back to the sitting position under the driving of the pull link 25.

Figure 5A:
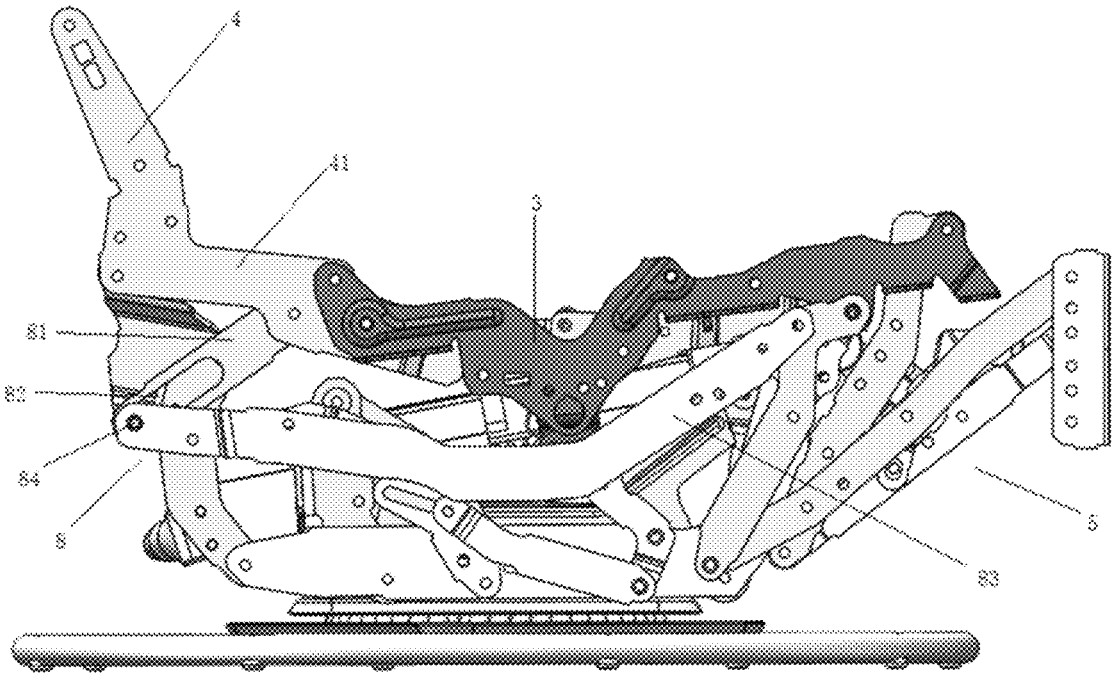
FIG. 5*a* shows a side view of the backrest locking mechanism when the seat unit is in the sitting position.
Figure 5B:
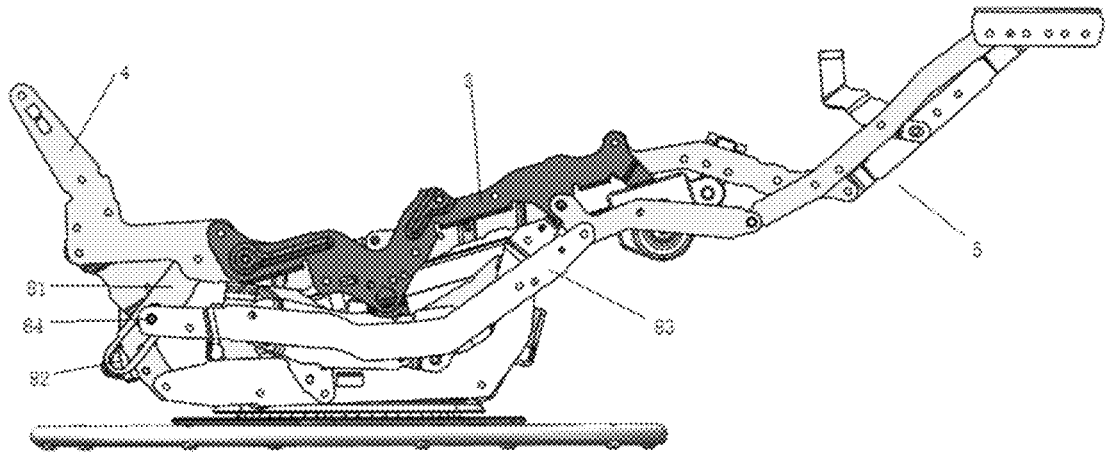
FIG. 5*b* shows a side view of the backrest locking mechanism when the seat unit is in the TV position.
Figure 5C:
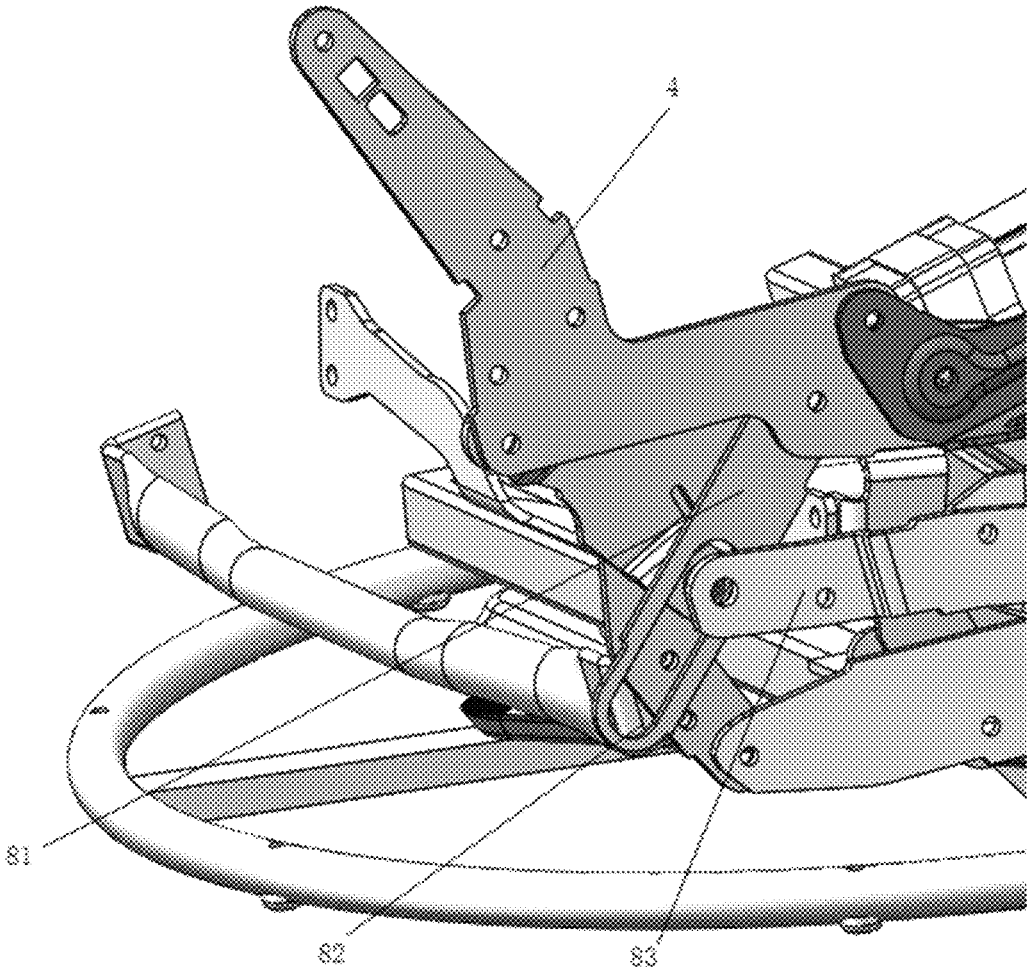
FIGS. 5*c* and 5*d* show partial views of the backrest locking mechanism when the leg extension unit is extended, respectively.
Figure 5D:
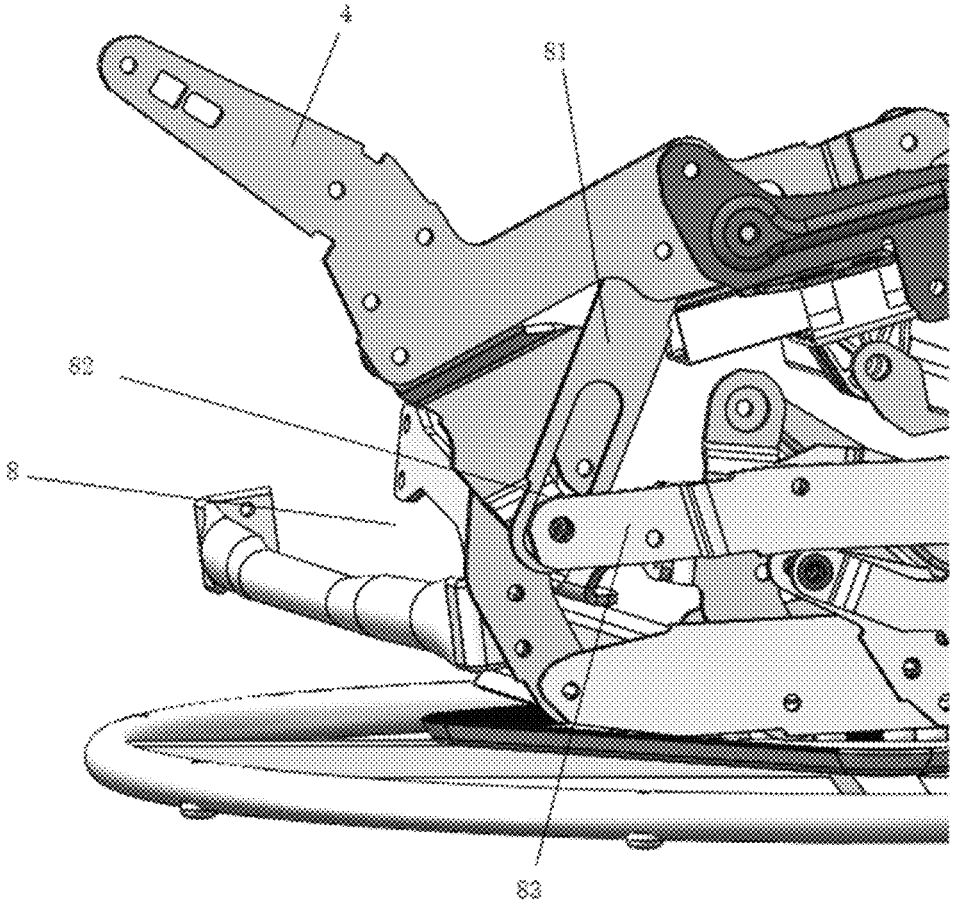

In one example, the backrest bracket 4 is equipped with a backrest locking mechanism 8. As shown in FIGS. 5*a* to 5*d*, the backrest locking mechanism 8 comprises a chute connector 81. One end of the chute connector 81 is pivotally connected to the horizontal section 41 of the backrest bracket 4, and backrest connector chute 82 is provided on another end of the chute connector 81. A locking member 84 is provided on one end of a longitudinally extending mounting member 83. The locking member 84 is slidably fitted in the backrest connector chute 82 of the chute connector 81. Another end of the mounting member 83 is pivotally connected to the third foot rod 53. As shown in FIG. 5*a*, in the sitting position, the leg extension unit 5 is completely folded, and the mounting member 83, with its locking member 84 at one end, abuts the lowermost part of the backrest connector chute 82 of the chute connector 81, thereby preventing the backrest bracket from tilting backward in the sitting position. As shown in FIGS. 5*b* and 5*c*, when the leg extension unit 5 is extended, the mounting member 83 moves forward under the driving of the leg extension unit, causing the locking member 84 at an end of the mounting member 83 to move forward in the backrest connector chute 82, and no longer abuts the lowermost part of the backrest connector chute 82, thereby allowing the backrest bracket 4 to tilt backward. As the backrest bracket 4 tilts backward, the chute connector 81 moves upward until the locking member 84 of the mounting member 83 abuts the lowermost part of the backrest connector chute 82 again, thereby reaching the maximum tilt degree of backrest bracket shown in FIG. 5*d*.

Figure 6A:
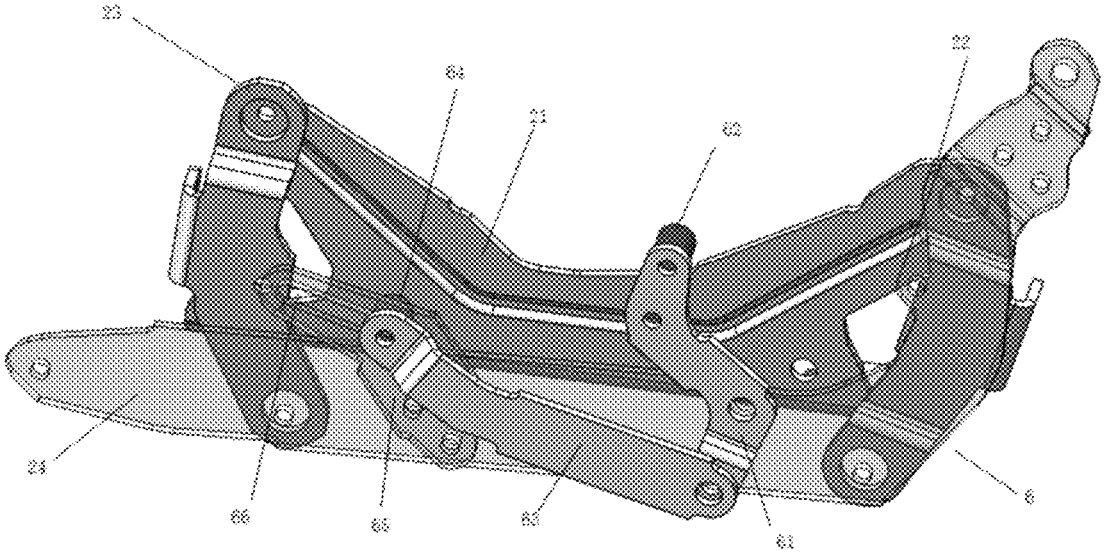
FIGS. 6*a* and 6*b* show a swing release state and a swing limit state of the swing limit mechanism, respectively.
Figure 6B:
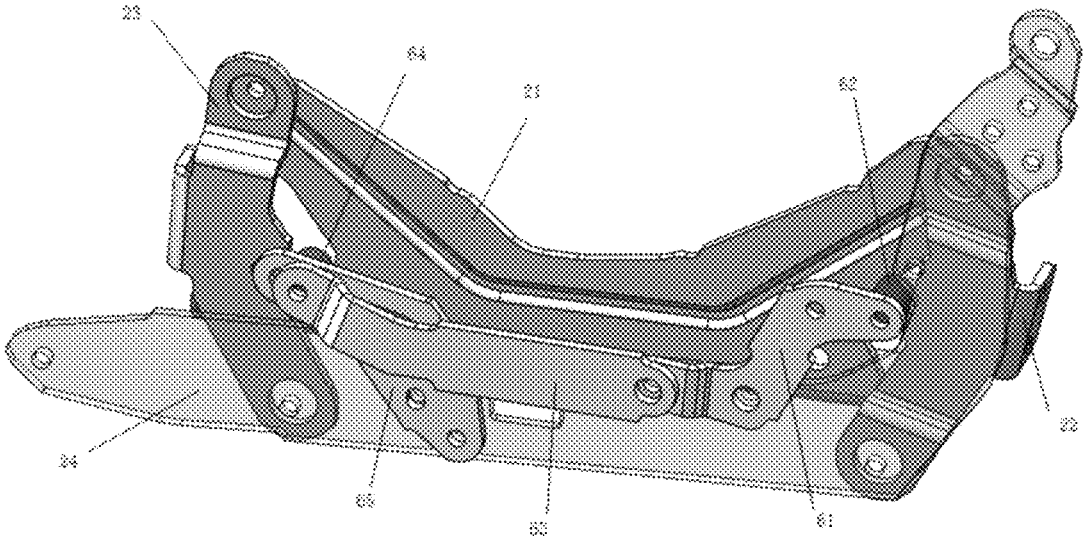

As shown in FIGS. 6*a* and 6*b*, in one or more examples, the mechanical extension apparatus has a swing limit mechanism 6. The swing limit mechanism comprises a first limit member 61, a second limit member 63, and a chute limit member 65. A middle part of the first limit member 61 is pivotally connected to the transmission link 24. A second limit bush 64 is provided on a front end of the first limiting member 61. A rear end of the first limit member 61 and a front end of the second limit member 63 are pivotally connected. A second limit bush 64 is provided on a rear end of the second limit member. The chute limit 65 is fixedly connected to the transmission link 24 and extends upward from the transmission link to provide a section with a swing limit chute 66. The second limit bush 64 is movably fitted in the swing limit chute 66. The swing limit mechanism 6 can switch between a swing release state and a swing limit state. In the swing release state as shown in FIG. 6*a*, the reclining apparatus 2 is in the sitting position, and the first limit bush 62 and the second limit bush are not in contact with the front swing rod 22 and the rear swing rod 23, thereby allowing the front swing rod 22 and the rear swing rod to pivot the forward and backward, thus enabling reclining apparatus to swing back and forth relative to the base. In the swing limit state shown in FIG. 6*b*, the leg extension unit is extended, and the second limit bush 64 and the second limit bush 64 move away from each other in opposite directions, respectively, where the second limit bush 64 moves forward toward the front swing rod 22, and the second limit bush 64 moves backward toward the rear swing rod 23 in the swing limit chute 66. When the chair unit reaches the lying position, the leg extension unit is completely extended. At this time, the first limit bush 62 abuts an inner side of the front swing rod 22, and the second limit bush abuts an inner side of the rear swing rod 23, thereby preventing the front and rear swing rods 15, 16 from pivoting, so that the reclining apparatus can no longer swing, glide or rock back and forth relative to the base.

Figure 7:
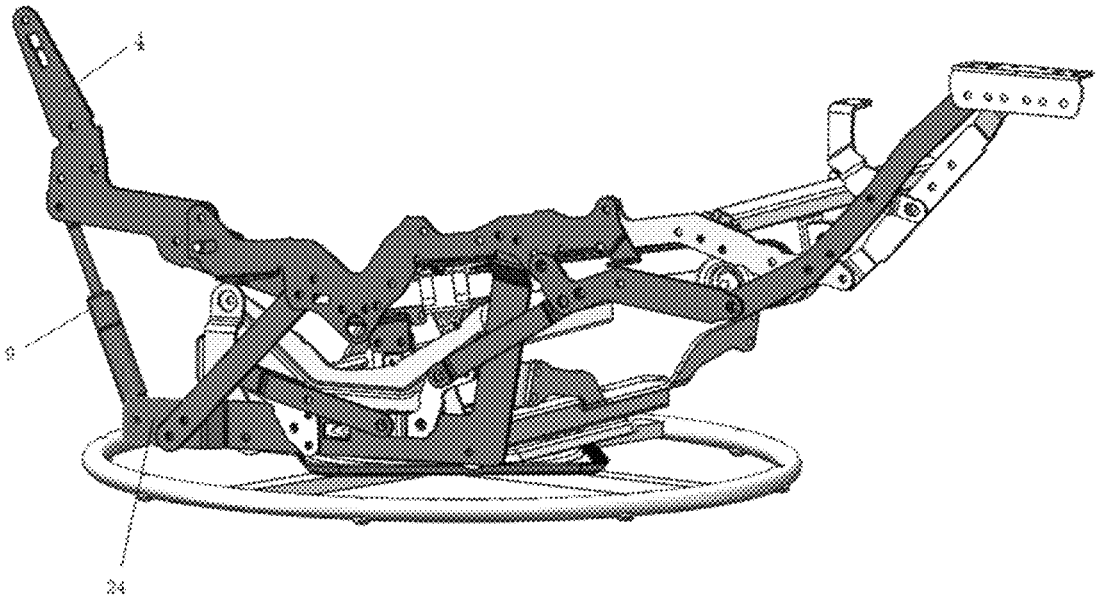
FIG. 7 shows another alternative example of the mechanical extension apparatus according to the present disclosure.

In another example as shown in FIG. 7, a pneumatic spring 9 may substitute the rear connector 27 and the backrest connector 43. A pneumatic spring 9 is provided at the pivot point M between the backrest bracket 4 and the rear end of the transmission link 24. The pneumatic spring 9 is designed to, starting from the TV position, when the user leans backward on the backrest, the backrest bracket is pressed down to the lying position by the user's weight. When the user gets up, the pneumatic spring supports the backrest bracket to restore to the TV position.

Figure 8A:
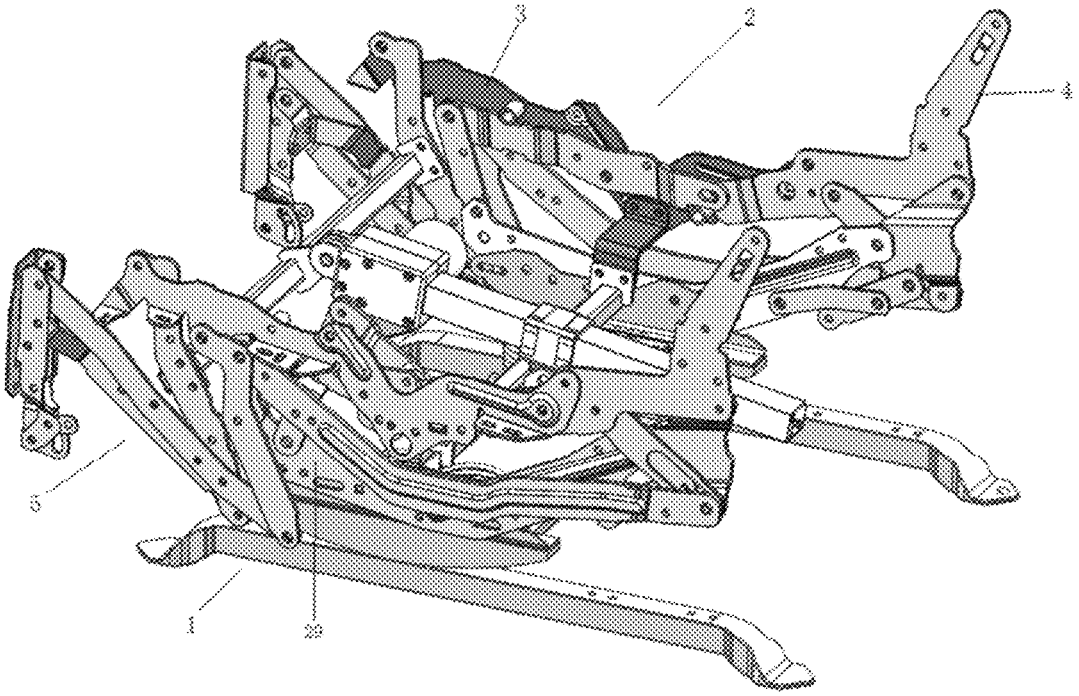
FIGS. 8*a* to 8*c* show another alternative example of the mechanical extension apparatus according to the present disclosure.
Figure 8B:
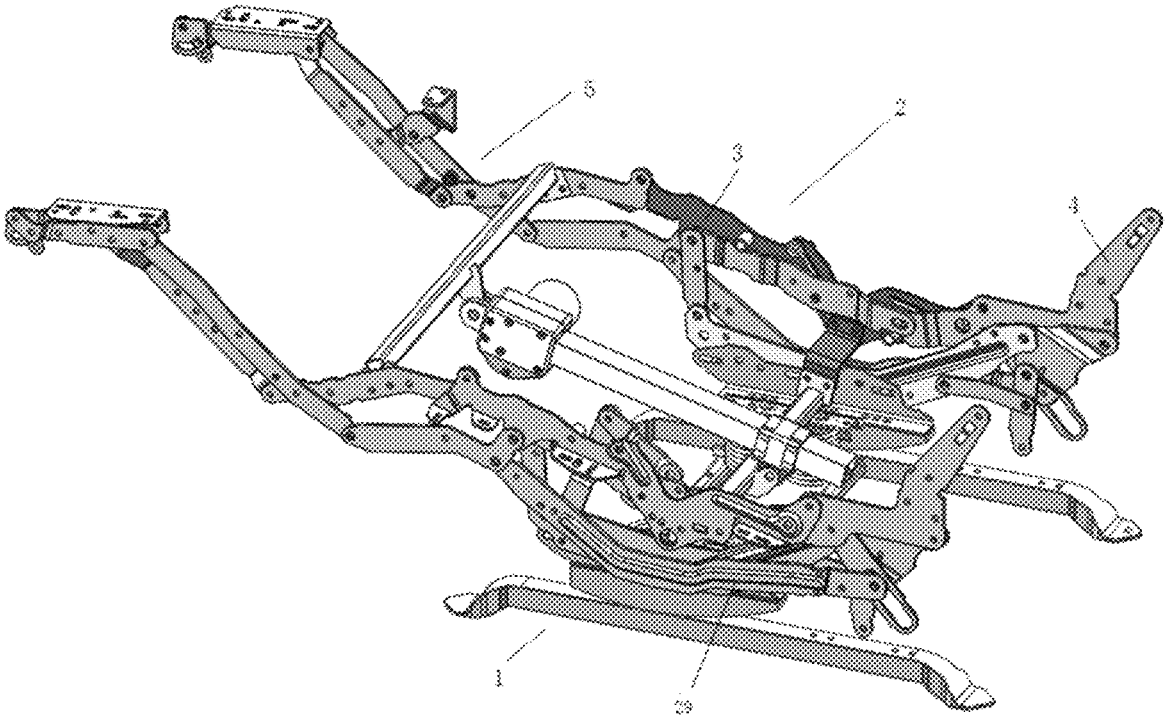
Figure 8C:
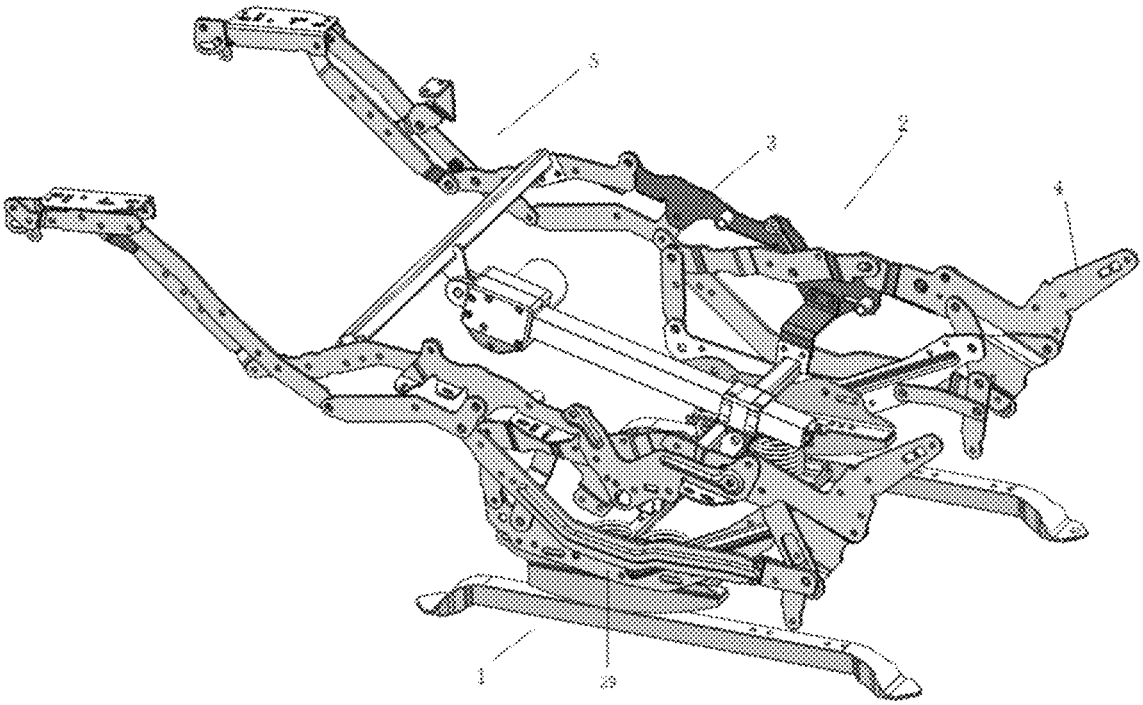

In an example shown in FIGS. 8*a* to 8*c*, a rocking base plate 29 substitutes the swing base plate in the above-mentioned reclining apparatus. A bottom part of the rocking base plate 29 is fixed on the base 1 with a rocker function. Among them, FIGS. 8*a*, 8*b* and 8*c* show the form of the chair unit in the sitting position, the TV position and the lying position, respectively. The rest of the technical features that are the same as those in the examples of FIGS. 1*a* to 7 and will not be repeated here.

The present disclosure is to provide a chair unit with a simple structure, simple operation and low manufacturing cost.

The present disclosure provides a mechanical extension apparatus for an extendable chair unit, the mechanical extension apparatus comprises:

A reclining apparatus, comprising a multi-link mechanism for attaching to a seat part, a backrest and a footrest of the chair unit, configured to enable the chair unit to convert from a sitting position to a TV position and then to a lying position in sequence or in reverse sequence. In the sitting position, the footrest is folded below the seat part; in the TV position, the footrest is located in front of the seat part, and the relative positions of the seat part and the backrest remain substantially the same as in the sitting position. In the lying position, the relative positions of the footrest and the seat part remain substantially the same as in the TV position, and the angle between the seat part and the backrest increases relative to that in the TV position.

It should be noted that the phrases "substantially the same" and "same" used here mean that in the corresponding conversion process, the relative positions of the seat part and the backrest (such as the angle formed by the two) and relative positions of the footrest and the seat part (for example, the angle formed by the two) remain unchanged or is not easily noticeable even if there is a change, for example, the angle change does not exceed 2°, preferably 1°.

According to the present disclosure, the reclining apparatus is configured such that the conversion of the chair unit between the sitting position and the TV position can be realized by an electric actuation unit, while the conversion of the chair unit between the TV position and the lying position can only be achieved by non-electric actuation, such as manual, hydraulic, pneumatic or spring actuation.

The electric actuation unit only needs to be responsible for the conversion between two positions, that is, the conversion between the sitting position and the TV position, while the conversion between the TV position and the lying position does not need to be realized by an electric actuation unit. Therefore, the related design structure is simple and the manufacturing cost is low.

In an example of the present disclosure, the conversion of the chair unit between the TV position and the lying position can be achieved by human labor, where when the user sitting on the chair presses backward on the backrest, the weight center of the user falls on the backrest bracket, and the force exerted on the backrest causes the reclining apparatus to convert from the TV position to the lying position; when the user gets up and shifts the weight center forward from the backrest bracket to the seat bracket, the force exerted on the backrest bracket is withdrawn, and the reclining apparatus can be reset from the lying position to the TV position.

In such examples, there is no need to provide additional switching elements between the electric drive system and the manual drive system, such as a switch handle, a switch key, etc., and users can easily use their own weight, by leaning backward and getting up forward, to complete the conversion between the TV position and the lying position.

In an example of the present disclosure, when the reclining apparatus is configured to swing, glide or rock the chair unit, the chair unit in the sitting position is allowed to swing, glide, or rock back and forth relative to the ground, while in the TV position and lying position, the chair unit is not allowed to swing, glide or rock back and forth relative to the ground. To achieve this, the reclining apparatus comprises a swing limit mechanism. The swing limit mechanism is designed to allow the seat bracket and backrest bracket to swing back and forth relative to the base in the sitting position, and prevent the seat bracket to swing back and forth relative to the base in the lying position.

In an example of the present disclosure, the mechanical extension apparatus comprises a support assembly for directly or indirectly supporting on the ground, and preferably providing a rocking or gliding function for the chair unit.

In an example of the present disclosure, the reclining apparatus comprises a leg extension unit for mounting a footrest, a seat bracket for mounting a seat part, and a backrest bracket for mounting a backrest, which are pivotally connected in sequence.

The leg extension unit is connected with a front crossbar, and the seat bracket is fixedly connected with a rear crossbar, where the front crossbar may be moved forward relative to the rear crossbar by the electric actuation unit, causing the footrest to move to the front of the seat part.

In an example of the present disclosure, the rear crossbar is directly or indirectly, fixedly or rigidly connected to the seat bracket.

In an example of the present disclosure, the mechanical extension apparatus further comprises a pull link, a rear end of the pull link is pivotally connected to the backrest bracket in front of the pivot connection point of the seat bracket and the backrest bracket, a front end of the pull link is pivotally connected to the support assembly, preferably pivotally connected to a front end of the transmission link in the support assembly, and the pull link is pivotally connected to the seat bracket in the middle.

In the example, the pivotal connection among the pull link, the seat bracket and the backrest bracket, especially the pivotal connection between the pull link and the seat bracket in the middle, enables that when the user gets up thereby the user's weight center moves forward from the backrest to the seat bracket, the user's own weight is utilized mechanically advantageously to drive the pull link downward, thereby drive the backrest bracket pivotally connected to the rear end of the pull link to flip forward, realizing the conversion of the chair unit from the lying position to the TV position in a simple, reliable and labor-saving manner.

Optionally, a long hole is provided on the front end of the backrest bracket, a pin is provided on the rear end of the pull link, or a pin is provided on the front end of the backrest bracket, and a long hole is provided the rear end of the pull link, where the front end of the backrest bracket is connected with the rear end of the pull link through an extendable fitting of the pin in the long hole.

This example provides certain degrees of longitudinal freedom for relative movement between the backrest bracket and the pull link, prevents jamming that potentially occurs when switching between the TV position and the lying position, and ensures a fluent relative movement between the backrest bracket and the pull link.

In an example of the present disclosure, the components of the electric actuation unit, optionally a linear motor unit, are connected to the front crossbar and the rear crossbar respectively.

In an example of the present disclosure, the electric actuation unit is a linear motor unit, comprising a motor head, a motor slide rail connected to the motor head, and a motor slider slidable relative to the motor slide rail. One end of the electric actuation unit, for example, a motor head, is pivotally connected to the front crossbar fixedly connected to the leg extension unit, and another end of the electric actuation unit, for example, a motor slider, is pivotally connected to the rear crossbar fixedly connected with the seat bracket, thereby when the motor head moves longitudinally along the longitudinal axis of the motor slide rail relative to the motor slider, the front crossbar drives the leg extension unit to extend forward or fold backward, so that the chair unit is converted between the sitting position and the TV position. Of course, a reverse design may also be adopted, for example, the motor slider of the electric actuation unit is pivotally connected to the front crossbar fixedly connected with the leg extension unit, and the motor head of the electric actuation unit may be pivotally connected to the rear crossbar fixedly connected with the seat bracket.

In an example of the present disclosure, when the user moves his/her weight center backward, causing a force to press against the backrest bracket, the backrest bracket may be flipped backward and thus connected to the seat bracket, thereby the seat bracket can be raised when the backrest bracket is flipped backward, so as to converting between the TV position and the lying position. To achieve this, it can be stipulated that the front end of the backrest bracket is connected to the pull link of the reclining apparatus, and is pivotally connected to the rear end of the seat bracket in a middle part, and a front end of the seat bracket opposite to the rear end is pivotally connected with the leg extension unit. In this design, the rear crossbar is directly fixedly connected to the seat bracket, or indirectly fixedly connected to the seat bracket through an intermediate piece, so that a longitudinal driving force generated by the motor drive unit cannot be effectively transmitted from the rear crossbar to the backrest, rather it is absorbed by the seat bracket, thereby cutting off the power transmission chain from the electric actuation unit to the backrest bracket. When the user moves his/her weight center forward and withdraws the force pressing on the backrest, the user can press downward and the backrest bracket can be flipped forward around the pivot point of the backrest, thereby resetting from the lying position to the TV position.

In this situation, there is no need to use an electric actuation unit, and the conversion of the chair unit between the TV position and the lying position can be completed only by a backward pressure exerted by the user and a simple get-up movement. In addition, since the rear crossbar is directly or indirectly fixedly connected to the seat bracket, the original complex power connection between the rear crossbar and the pull link, and between the pull link and the leg extension unit with complicated shapes and a big amount in the prior art is omitted. Therefore, this structure is simpler, fewer parts are needed, and manufacturing costs are further reduced.

In an example of the present disclosure, the reclining apparatus further comprises a spring member for tightening the pull link and the seat bracket to each other, and the spring member is capable to provide a downward pulling force for the pull link when the backrest bracket flips forward, so as to assist the backrest to restore the sitting position; preferably, the action point of the pulling force of the spring member on the pull link is located behind the connecting point of the pull link and the seat bracket. The restoring force of the spring member is used to assist the seat bracket and the pull link moving towards each other, so that the backrest can be folded smoothly.

In another example of the present disclosure, the reclining apparatus is further provided with a pneumatic spring connected to the backrest pivot point of the backrest bracket, and the pneumatic spring is configured to support the backrest bracket to flip forward around the backrest pivot point when the user gets up, thereby supporting the backrest bracket to restore to the TV position and to the sitting position.

In an example of the present disclosure, the reclining apparatus further comprises a backrest locking mechanism. The backrest locking mechanism is designed, in the sitting position, to prevent the backrest from tilting backward, and in the lying position, to prevent the backrest from exceeding the maximum tilt degree. This prevents the user from accidentally leaning back excessively, thereby ensuring the safety of use.

The mechanical extension apparatus further comprises a base for directly supporting on the ground. The support assembly is fixedly supported on the base. The base may be a circular bracket designed to support on the ground. A fixed bracket comprising a set of parallel extending support rods is rotatably connected to the circular bracket, so that the chair unit has a rotation function in addition to a tilt function and a swing/glide/rock function. As an alternative, the base may also be simply configured as a set of parallel-extending ground brackets to directly support on the ground.

Optionally, the support assembly comprises a swing base plate, a front swing rod, a rear swing rod, and a transmission connecting rod mounted on the base, where a front end of the swing base plate is pivotally connected to a top end of the front swing rod, and a rear end of the swing base plate is pivotally connected to a top end of the rear swing rod, and the transmission connecting rod is pivotally connected to a lower end of the front swing rod and a lower end of the rear swing rod, respectively.

In addition, the present disclosure also relates to an extendable chair unit. The chair unit comprises: a base for supporting on the ground, a seat part located above the base, a backrest located behind the seat part, a footrest located in front of the seat part, the aforementioned mechanical extension apparatus, and an electric actuation unit for the chair unit to convert between the sitting position and the TV position. The extendable chair unit may be an extendable gliding chair, a rocking chair, particularly a sofa with a gliding or rocking function, and the like.

Figure 9:
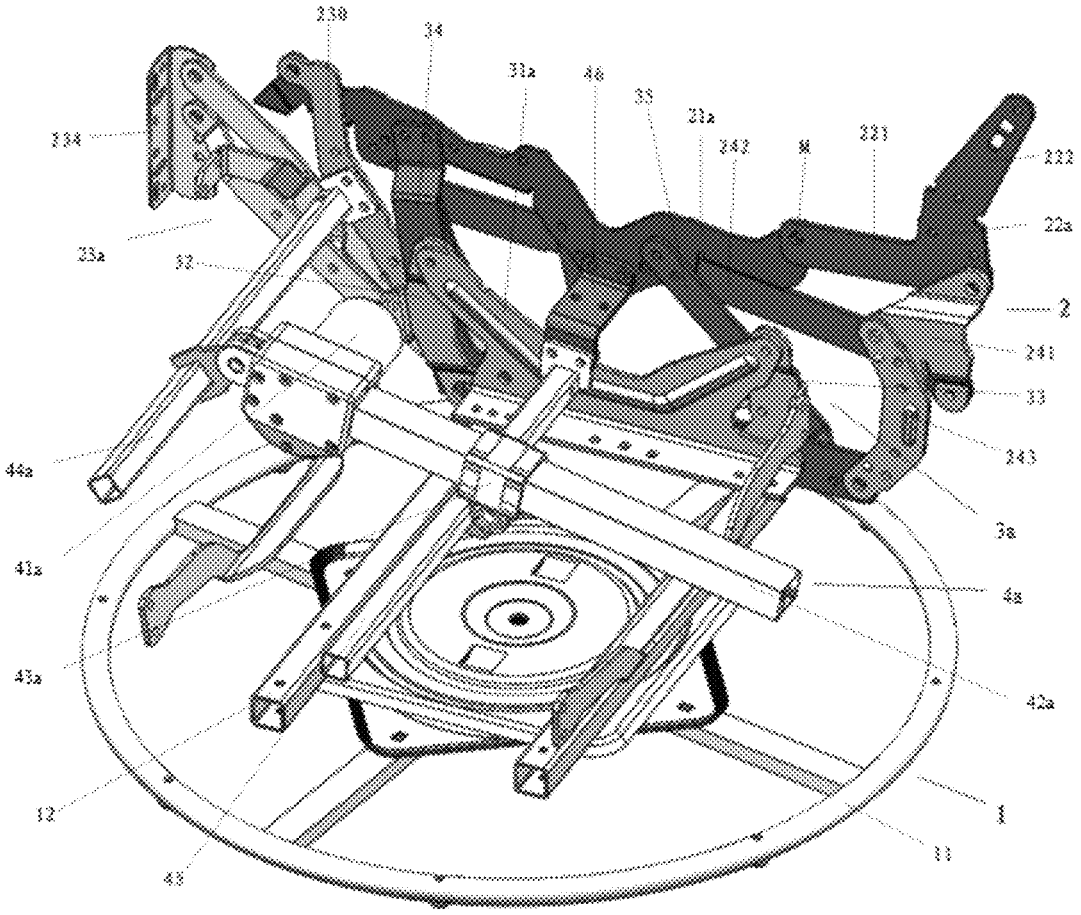
FIG. 9 shows a perspective view of an example of a mechanical extension apparatus, in a sitting position, of a chair unit configured as a swing chair according to the present disclosure.

Another example of a for an extendable chair unit is shown by FIG. 9. The chair unit comprises: a base 1, a reclining apparatus 2, a support assembly 3, and an electric actuation unit 4. In this example, the mechanical extension apparatus is configured to convert between two positions, the sitting position, and the lying position. In this example, when converting from the sitting position to the lying position, the footrest extends forward from a vertical position to a horizontal position in front of the seat, the backrest tilts backward away from the seat, and an angle between the seat and the backrest in the lying position increases. The footrest would reach the horizontal position at the same time as the backrest tilted backward to reach the end position for the lying position of the seating unit.

According to some examples, when the backrest of the chair unit is fully reclined, in the lying position, an angle between the fully reclined backrest and a horizontal plane, such as the ground supporting the chair unit, may be between 20-30 degrees. While in this lying position, the footrest is fully extended, and is generally horizontally disposed in front of the seat, parallel to the ground supporting the chair unit. When the chair unit is in the sitting position, the backrest is relatively upright, and an angle between the backrest and the horizontal plane may be about 50-60 degrees.

In some examples of the present disclosure, when a user activates the conversion of the chair unit, both the footrest and the backrest may start transforming at the same time. In other words, when converting from the sitting position to the lying position, the backrest may start reclining, and the footrest may start extending towards the front of the seat simultaneously. Both the backrest and the footrest may reach its final position as in the lying position at the same time. During the conversion, the backrest may recline about 30-40 degrees, and the footrest extends from a generally vertical position below the seat to a generally horizontal position in front of the seat. In this case, the moving speed of the footrest may be faster than the reclining speed of the backrest. In some other examples, although both footrest and the backrest may start moving at the same time, they may reach its final position at different times. In such cases, when the backrest is fully reclined, the footrest may partially extend to the front of the seat and the angle between the footrest and a horizontal plane may be between 30 and 50 degrees. Moving speeds of the backrest and the footrest in these cases may be the same or may be different.

The base 1 may be designed as a circular bracket 11 supported on the ground as shown in FIG. 9. A fixing bracket 12 comprising a set of parallel extending support rods is rotatably connected to the circular support.

Alternatively, in other examples not shown, the base 1 may also be configured as a set of parallelly-extending ground-contact brackets directly supported on the ground.

Above the base 1, specifically, in the example shown in FIG. 9, a reclining apparatus 2 is fixedly connected to the fixing bracket 12. The reclining apparatus 2 is arranged mirror-symmetrically on the left and right sides relative to the longitudinal direction of the chair unit. For the sake of brevity, only half of the reclining apparatus 2 is shown and specifically explained. The reclining apparatus comprises a seat bracket 21, a backrest bracket 22*a* and a leg extension unit 23.

In this example, the backrest bracket 22*a* is configured to have a horizontal section 221 that extends substantially horizontally and a vertical section 222 that extends substantially vertically in the sitting position. In a front end of the horizontal section may be pivotally connected to a rear end of the seat bracket 21*a* at a backrest pivot point M. The backrest bracket 22*a* may be turned back and forth around the pivot point M of the backrest.

As shown in FIGS. 9 to 12, the leg extension unit 23*a* is composed of a plurality of linkage links which are pivotally connected to each other, where the seat bracket 21*a* is pivotally connected with a rear end of a front connector 230 at a first pivot point A, a front end of the front connector 230 is pivotally connected to a rear end of the first foot rod 231 at a second pivot point B, and front ends of the first foot rod 231 and a second foot rod 232 are pivotally connected to the footrest support plate 234 respectively, a rear end of the second foot rod 232 is pivotally connected to a front end of a third foot rod 233 at a third pivot point C, a rear end of the third foot rod 233 is pivotally connected to the seat bracket 21*a* at a fourth pivot point D, and the second foot rod 232 is pivotally connected to the front connector 230 at a fifth pivot point E.

Figure 10:
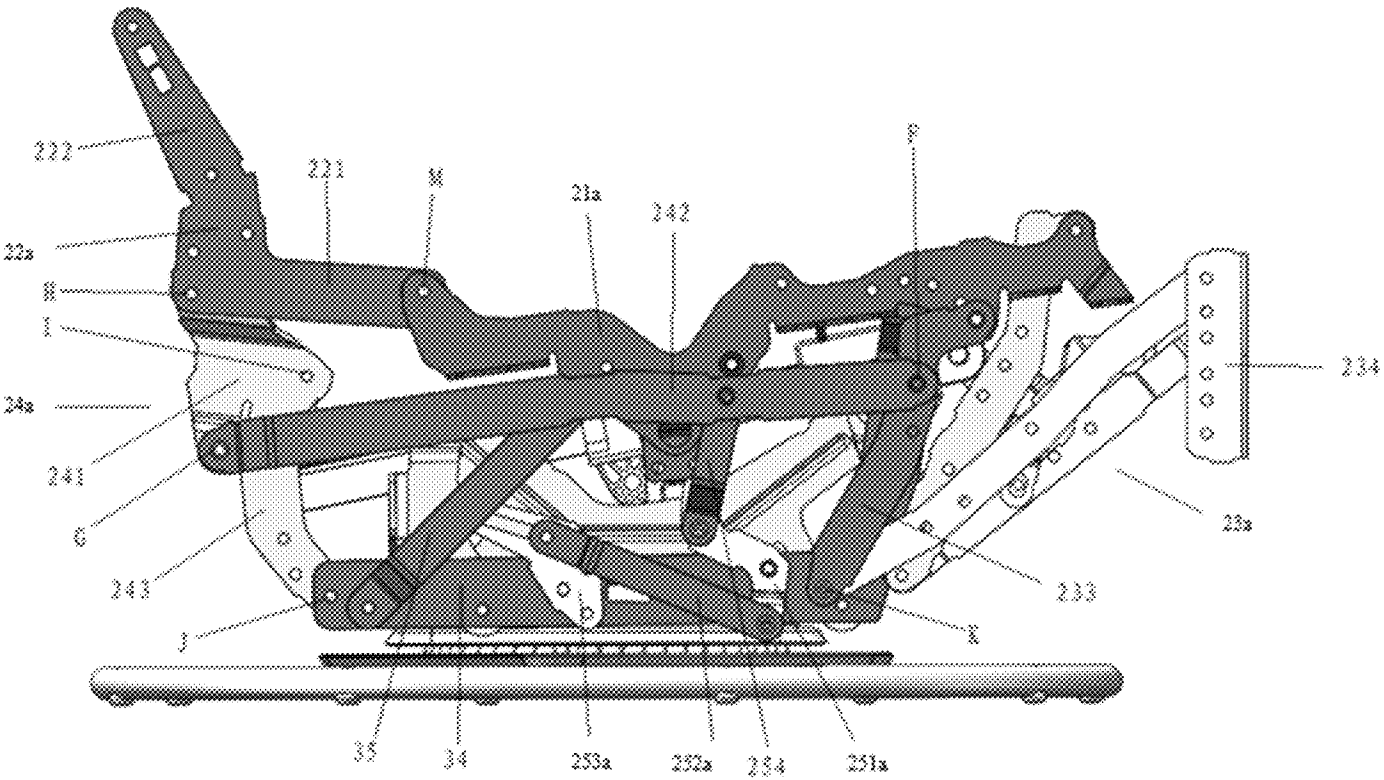
FIG. 10 shows a side view of the mechanical extension apparatus according to FIG. 9.
Figure 12:
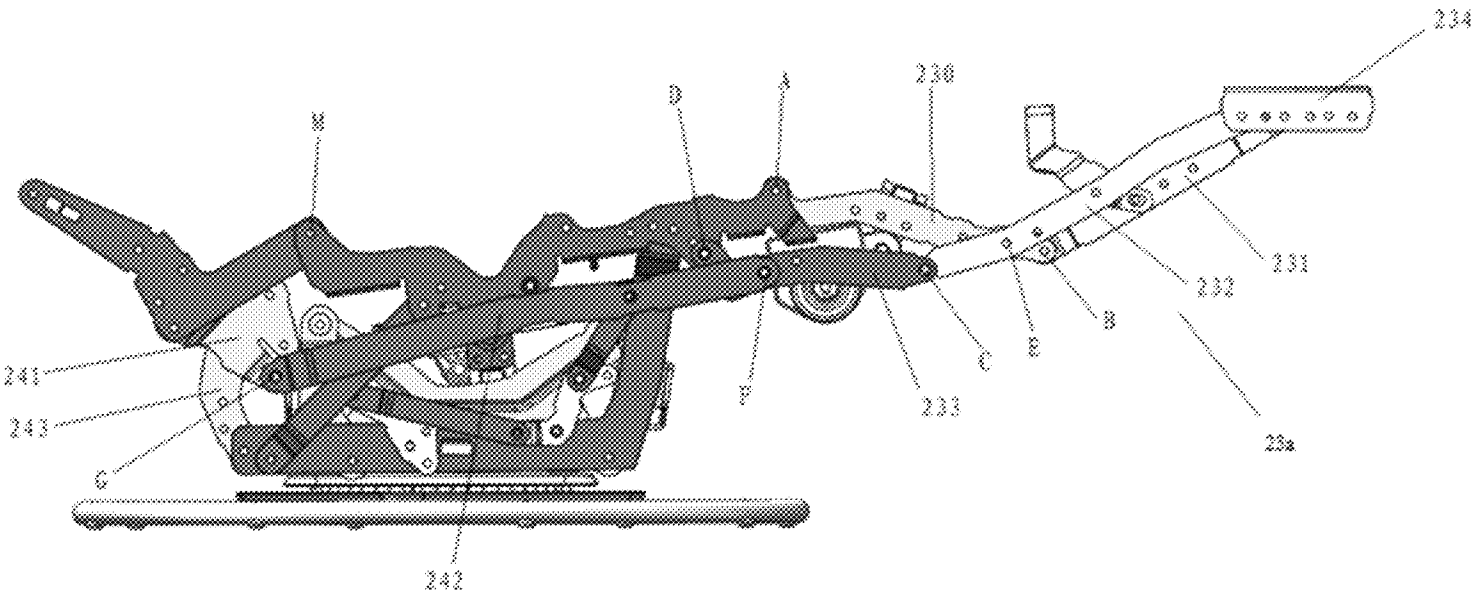
FIG. 12 shows a side view of the mechanical extension apparatus according to FIG. 11.

As shown in FIGS. 10 and 12, the reclining apparatus 2 further comprises a linkage device 24*a*. The linkage device 24*a* comprises a backrest connector 241 and a linkage link 242 extending substantially along the longitudinal direction of the chair unit. In the example shown, a front end of the linkage link 242 is pivotally connected to a middle part of the third foot rod 233 of the leg extension unit 23*a* at a sixth pivot point F. A rear end of the linkage link 242 is pivotally connected to the backrest connector 241 at a seventh pivot point G. The backrest connector 241 is pivotally connected to the backrest bracket 22*a* at an eighth pivot point H.

The mechanical extension apparatus further comprises a support assembly 3*a*. Particularly, as shown in FIGS. 9 and 11, the support assembly 3*a* comprises a swing base plate 31*a*, a front swing rod 32, a rear swing rod 33, and a transmission link 34, where a bottom part of the swing base plate 31*a* is fixedly connected to a fixing bracket 12 of the base 1, a front end on the top of swing base plate 31*a*, is pivotally connected to a top end of the front swing rod 32, and a rear end on the top of the swing base plate 31*a* is pivotally connected to a top end of the rear swing rod 33, and lower ends of the front swing rod 32 and the rear swing rod 33 are pivotally connected to the longitudinally-extending transmission link 34, respectively.

Optionally, in an example, a front end of the transmission link 34 is connected, particularly riveted or welded, and a rear end of the transmission link 34, through the rear connector 243, is pivotally connected to the backrest connecting piece 241. In an example, a top end of the rear connector 243 is pivotally connected to a rear end of the transmission link 34 at a tenth pivot point J.

In an example, a support link 35 is additionally provided between the transmission link 34 and the seat bracket 21*a*. One end of the support link 35 is pivotally connected to the transmission link 34, and another end of the support link 35 is fixedly connected to the seat bracket 21*a*, so that the relative positions of the transmission link 34 and the seat bracket 21*a* are maintained stably when the transmission link 34 is fixedly connected to the seat bracket 21*a*.

Figure 11:
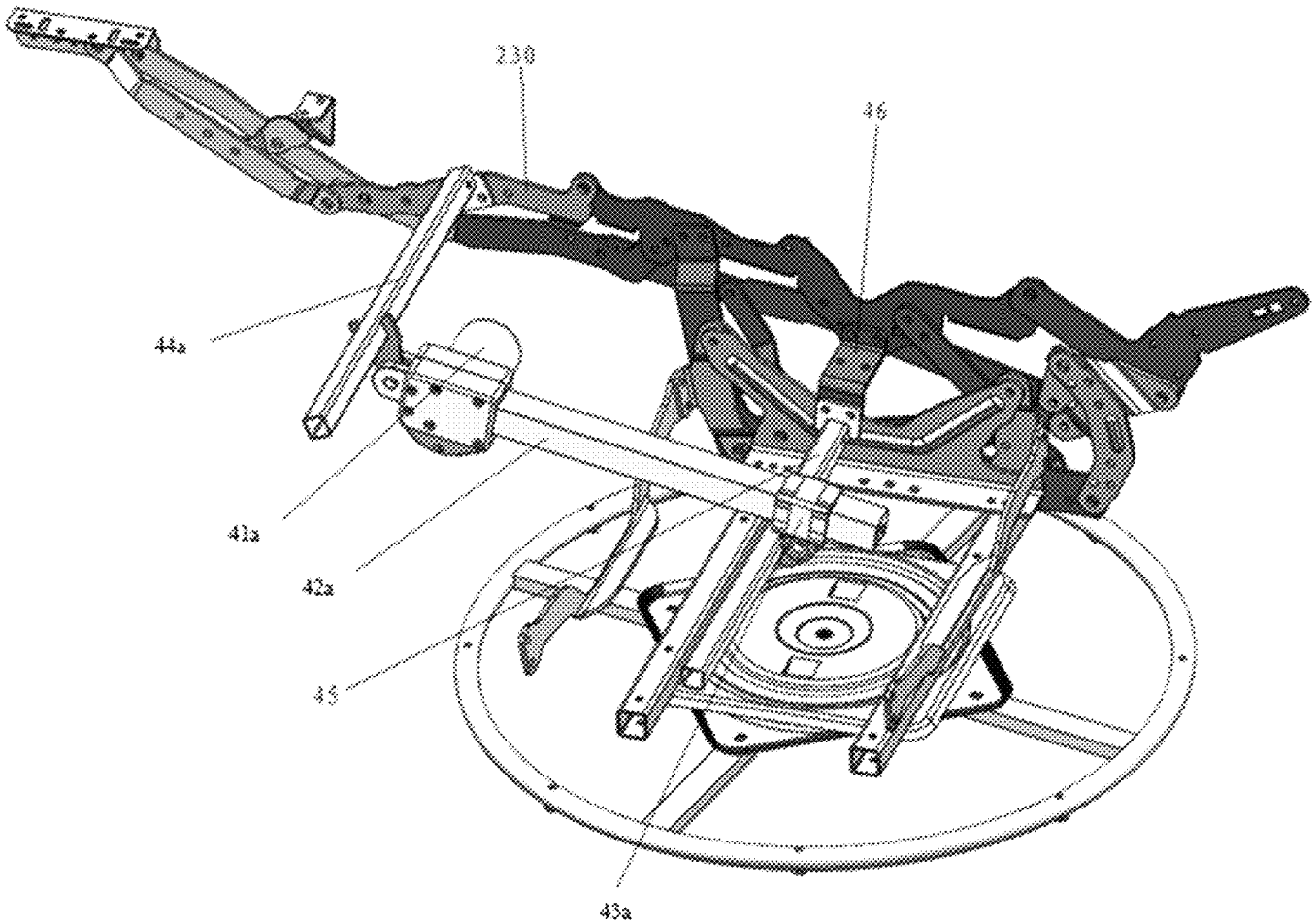
FIG. 11 shows a perspective view of the mechanical extension apparatus in a lying position according to FIG. 9.

Particularly, as shown in FIGS. 9 and 11, the chair unit further comprises an electric actuation unit 4*a*, which in this example is a linear motor unit, comprising a motor head 41*a*, a motor slide rail 42*a* connected to the motor head 41*a*, and a motor slider 43*a* slidable relative to the motor slide rail 42*a*, where the motor head 41*a* is pivotally connected to a front crossbar 44*a*, the front crossbar 44*a* is fixedly connected to the front connector 230 of the leg extension unit 23*a*, the motor slider 43*a* may be pivotally connected to a rear crossbar 45, and both ends of the rear crossbar 45 are, through intermediate connector 46, fixedly connected to a middle part of the seat bracket 21*a*, respectively. Thereby, when the motor head 41*a* moves longitudinally back and forth relative to the motor slider 43*a* along the motor slide rail 42*a*, the front crossbar 44*a*, through the front connector 230, drives the leg extension unit 230 to extend forward or fold backward.

The work modes of the chair unit converting between the sitting position and the lying position are explained below with reference to FIGS. 9 to 12.

In the sitting position shown in FIGS. 9 and 10, the backrest bracket 22*a* is substantially vertically oriented, the seat bracket 21*a* is substantially horizontally oriented, and the footrest support plate 234 is substantially vertically oriented, and the leg extension unit 23*a* is completely folded below the seat bracket 21*a;* in the lying position shown in FIGS. 11 and 12, the leg extension unit 23*a* is completely extended forward, and the backrest bracket 22*a* is completely tilted backward.

When the motor head 41*a* runs in a forward direction, the position of the seat bracket 3 remains substantially unchanged in the longitudinal direction due to gravity of the user, the motor head 41*a* moves forward relative to the motor slider 43*a* along the motor slide rail 42*a* so that the distance between the motor head 41*a* and the motor slider 43*a* increases, thereby the front crossbar 44*a* drives the front connector 230 to rise forward, hence the leg extension unit 23*a* is completely extended from folded state in the sitting position as shown in FIGS. 9 and 10 to the unfolded state in the lying position as shown in FIGS. 11 and 12. At the same time, as the extension of the leg extension unit 23*a,* the linkage link 242 pivotally connected to the third foot rod 233 of the leg extension unit 23*a* at the sixth pivot point F is correspondingly driven to move forward, thereby the seventh pivot point G, which connects the rear end of the linkage link 242 and the backrest connector 241, moves forward. Since the relative positions of the seat bracket 21*a* and the transmission link 34 are fixed, the position of the backrest pivot point M remains substantially unchanged during the extension process of the leg extension unit 23*a,* thereby driving the eighth pivot point H of the backrest connector 241 to move downward, and pulling the backrest bracket 22*a* to flip backward and downward around the backrest pivot point M. As a result, at the same time as the leg extension unit 23*a* is extended forward, the backrest bracket 22*a* is tilted backward, thereby realizing the conversion of the chair unit from the sitting position to the lying position.

Starting from the lying position shown in FIGS. 11 and 12, if the motor head 41*a* runs in a reverse direction, the motor head 41*a* moves toward the motor slider 43*a* along the motor slide rail 42*a,* so that the distance between the motor head 41*a* and the motor slider 43*a* decreases, thereby the leg extension unit 23*a* is folded backward, and the linkage link 242 moves backward and drives the eighth pivot point H of the backrest connector 241 to move backward. At the same time, similarly, since the position of the backrest pivot point M is fixed, the eighth pivot point H on the backrest connector 241 moves upward, thereby pushing the backrest bracket 22*a* to flip upward and forward around the backrest pivot point. At the same time as the leg extension unit 23*a* is folded backward, the backrest bracket 22*a* is reset and tilted forward, thereby realizing the conversion of the chair unit from the lying position to the sitting position.

As shown in FIGS. 11 to 13*b*, in an example of the present disclosure, the mechanical extension apparatus has a swing limit mechanism 25*a.* The swing limit mechanism 25*a* comprises a first limit member 251, a second limit member 252, and a chute limit member 253 and limit link 254. A middle part of the first limit member 251 is pivotally connected to the transmission link 34 at the limiting pivot point K, and a first limit bush 251*a* is provided on a front end of the first limit member 251. A rear end of the first limit member 251 is pivotally connected to a front end of the second limit member 252. A second limit bush 252*a* is provided on a rear end of the second limit member 252. The chute limit member 253 is fixedly connected to the transmission link 34 and extends upward from the transmission link to provide a section with a limit chute 253*a.* The second limit bush 252*a* is movably fitted in the swing limit chute 253*a.* One end of the limit link 254 may be pivotally connected between the limit pivot point K of the first limit member 251 and the first limit bush 251*a,* and another end of the limit link 254 can be pivotally connected to the linkage link 242, thereby the limit link 254 may move under the driving of the linkage link 242, so that the swing limit mechanism 25 may switch between the swing release state and the swing limit state.

Figure 13A:
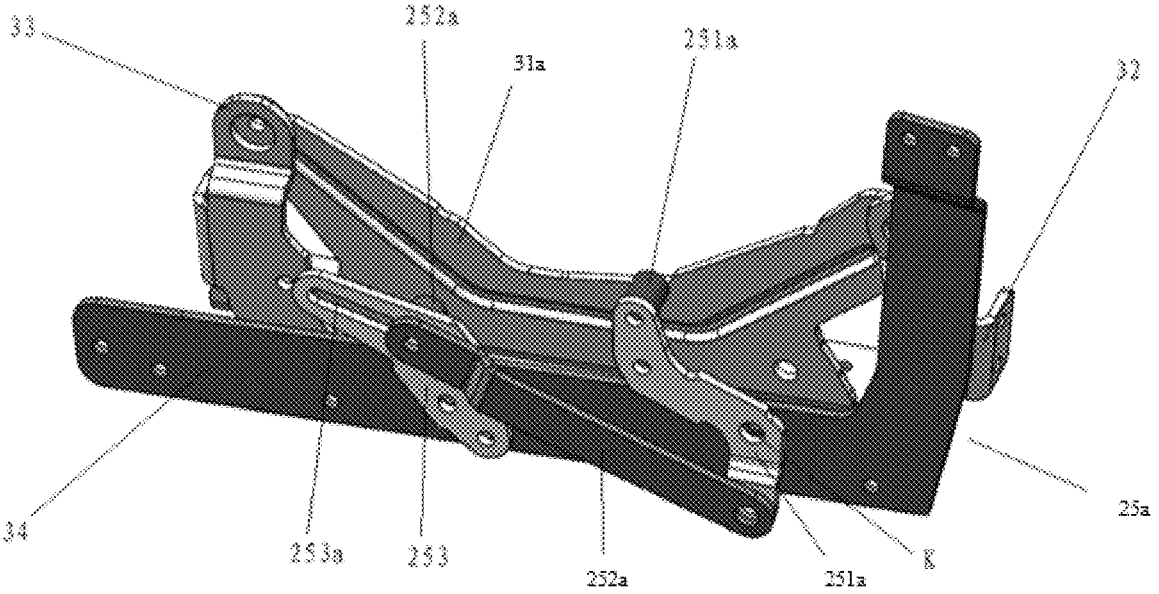
FIG. 13*a* and FIG. 13*b* show the swing release state and the swing limit state, respectively, of the swing limit mechanism for the mechanical extension apparatus according to the present disclosure.
Figure 13B:
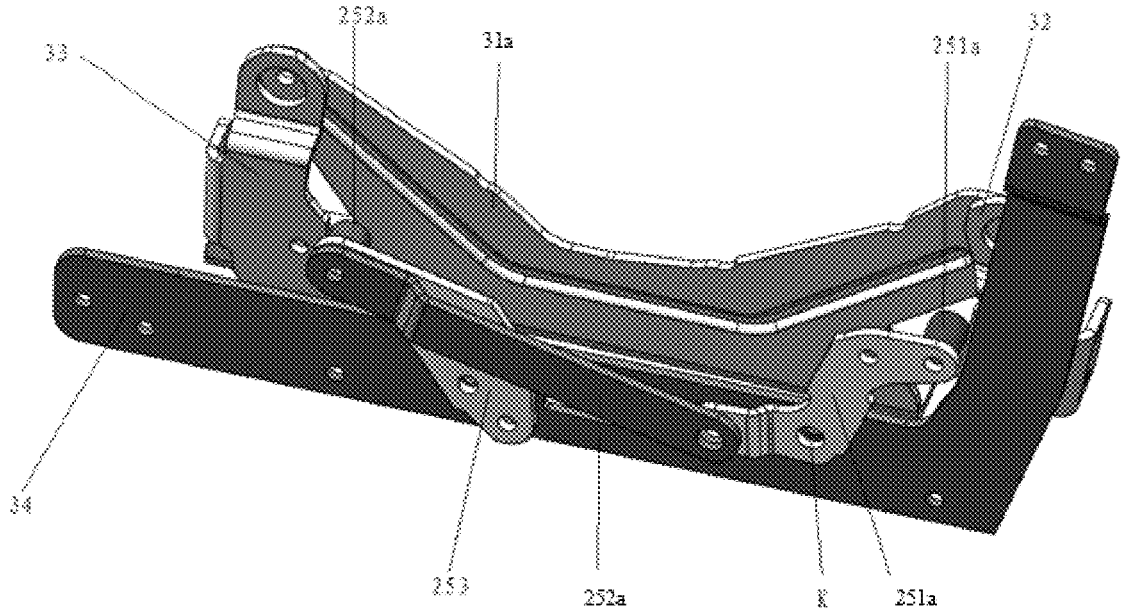

In the swing release state shown in FIG. 13*a*, the chair unit is in the sitting position. The first limit bush 251*a* and the second limit bush 252*a* are not in contact with the front swing rod 32 and the rear swing rod 33. This allows the front swing rod 32 and the rear swing rod 33 to pivot back and forth, so that the reclining apparatus 2 can swing back and forth relative to the base 1. When the chair unit converts from the sitting position to the lying position, the leg extension unit 23*a* extends, prompting the linkage link 242 to move forward, and the limit link 254 also moves forward under the traction of the linkage link 242, thereby driving the first limit member 251 pivots around the limiting pivot point K and moves with its first limit bush 251*a* until the first limit bush 251*a* abuts on the inner side of the front swing rod 32; at the same time, a rear end of the first limit member 251 moves backward, thereby pushing the second limit member 252 with its second limit bush 252*a* to move backward in the limit chute 253*a* of the chute limit member 253 until the first the second limit bush 252*a* abuts the inner side of the rear swing rod 33. As a result, the swing limit state as shown in FIG. 13*b* is achieved, thereby preventing the pivoting of the front and rear swing rods 32, 33, so that the reclining apparatus 2 can no longer swing back and forth relative to the base 1.

An example of a mechanical extension apparatus configured as a rocking chair is shown in FIGS. 14 to 17. Among them, a rocking base plate 31' may substitute the swing base plate in the above-mentioned support assembly, and the rocking base plate 31' is mounted on the base 1 with a rocking function at its bottom. In the illustrated example, the rocking base plate 31' is mounted on a set of parallel extending Ground brackets 13 configured to be directly supported on the ground, and the transmission link of the support assembly 3 is fixedly connected to the rocking base plate 31'. In this example, the transmission link comprises a first sub-piece 341 of the transmission link, which is close to the leg extension unit 23*a* and extends substantially vertically, and a second sub-piece 342 of the transmission link, which substantially extends substantially longitudinally. Of course, the transmission link may also be configured in one piece as in the example of the swing/gliding chair.

A support link 35 is also provided between the transmission link and the seat bracket 21*a.* One end of the support link 35 is fixedly connected to the seat bracket 21*a.* Another end of the support link 35 is fixedly connected to the transmission link, and in this example, it is fixedly connected to the second sub-piece 342 of the transmission link. Therefore, the mechanical extension apparatus also ensures the fixation of the relative position between the seat bracket 21*a* and the transmission link during the conversion between the sitting position and the lying position.

An eleventh pivot point L is additionally provided on the backrest connector 241 between the seventh pivot point G and the ninth pivot point I. In this example, the support assembly 3 further comprises a first auxiliary link 36 and a second auxiliary link 37, where one end of the first auxiliary link 36 is pivotally connected to the backrest connector 241 by the eleventh pivot point L. An auxiliary bush 37*a* is provided on one end of the second auxiliary link 37. Another and of the second auxiliary link 37, on which no auxiliary bush is provided, is pivotally connected to the transmission link, and preferably in this example, it is pivotally connected to the second sub-piece 342 of the transmission link. Another end of the first auxiliary link 36 is pivotally connected to the second auxiliary link 37 at the auxiliary pivot point N where the second auxiliary link 37 is close to the auxiliary bush 37*a*. The rest of the technical features that are the same as the examples in FIGS. 9 to 12 will not be repeated here.

Figure 14:
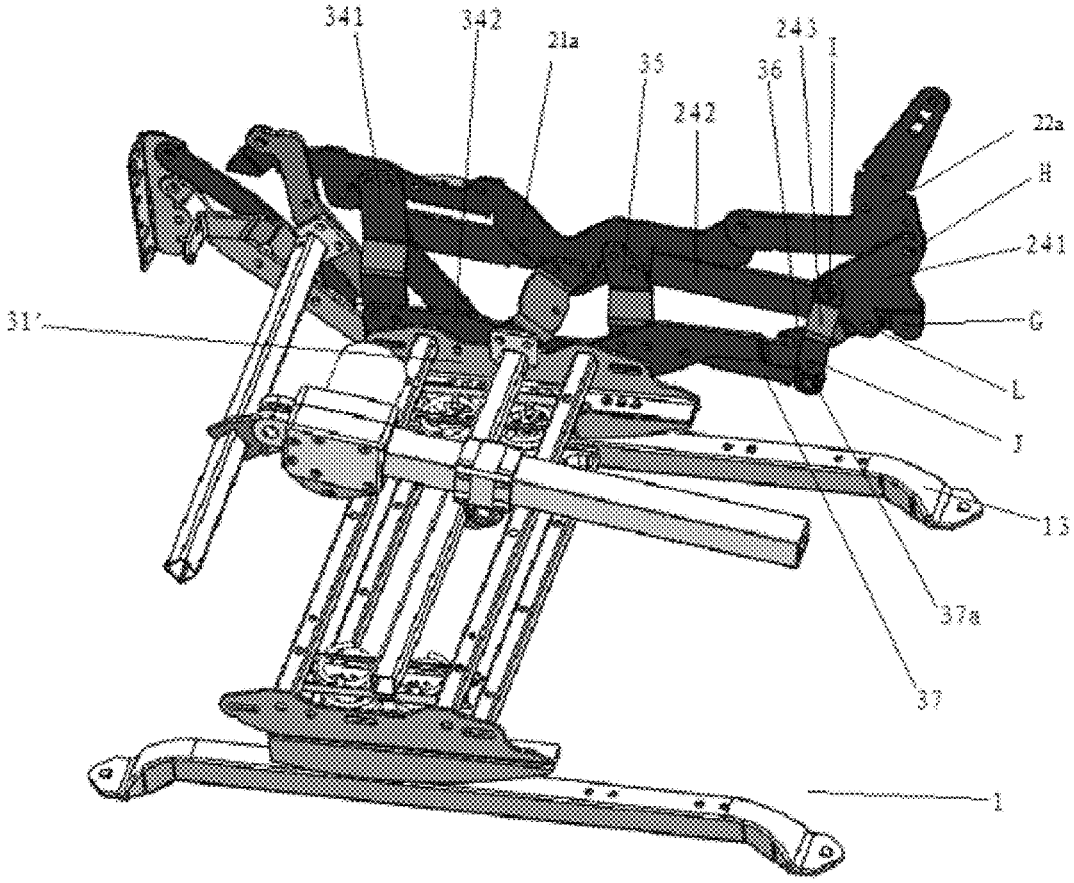
FIG. 14 shows a perspective view of an example of a mechanical extension apparatus, in a sitting position, of a chair unit configured as a rocking chair according to the present disclosure.
Figure 15:
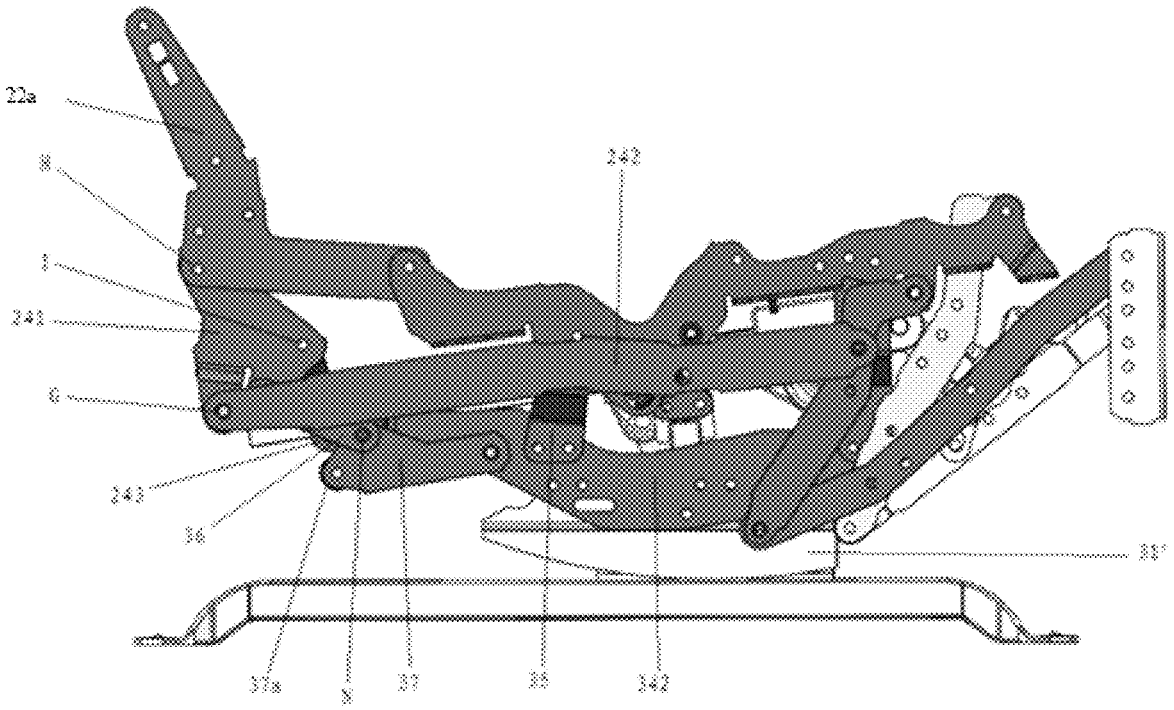
FIG. 15 shows a side view of the mechanical extension apparatus according to FIG. 14.

FIGS. 14 and 15 show a chair unit configured as a rocking chair in a sitting position. As shown in FIGS. 14 and 15, a first auxiliary link 36 is pivotally connected to the second auxiliary link 37 by an auxiliary pivot point N. Meanwhile, the auxiliary bush 37*a* at an end of the second auxiliary link 37 is maintained at a distance with the base 1, and in this example, it is maintained at a distance with the Ground bracket 13. In the lying position shown in FIGS. 16 and 17, the auxiliary bush 37*a* abuts on the base 1.

Figure 16:
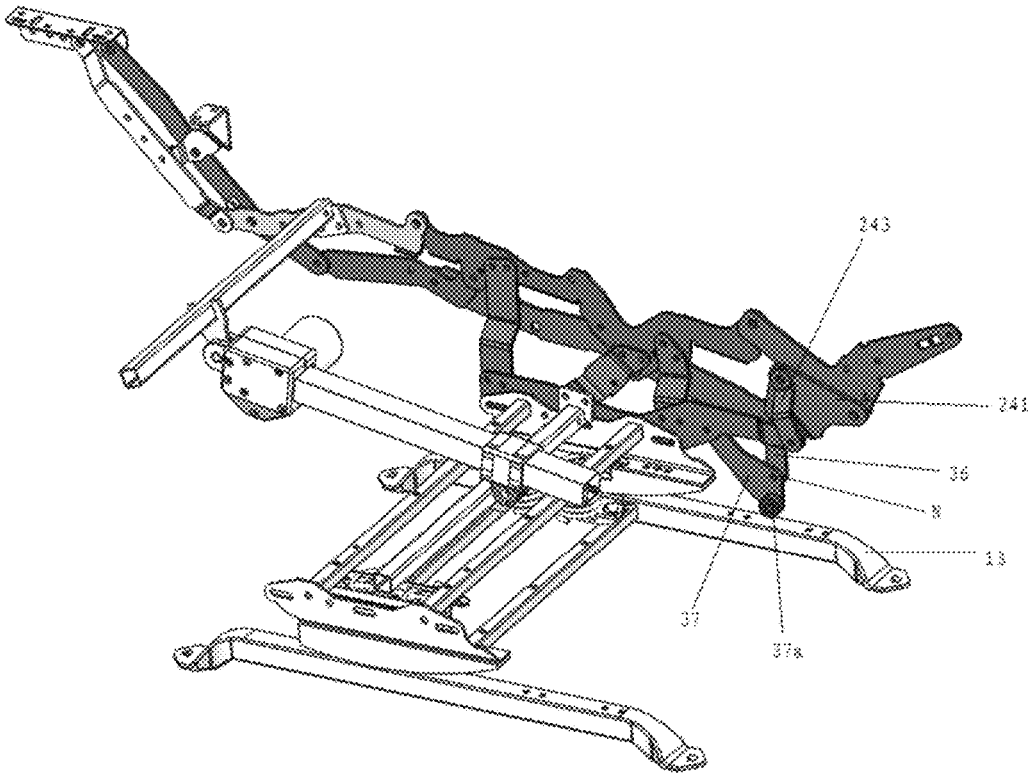
FIG. 16 shows a perspective view of the mechanical extension apparatus in a lying position according to FIG. 14.
Figure 17:
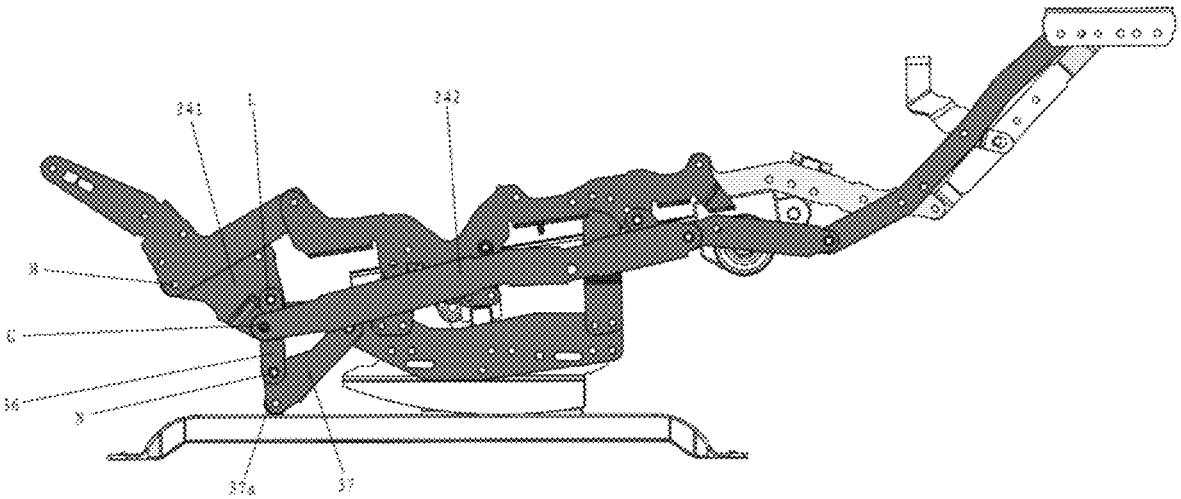
FIG. 17 shows a side view of the mechanical extension apparatus according to FIG. 16.

When the mechanical extension apparatus is converted from the sitting position shown in FIGS. 14 and 15 to the lying position shown in FIGS. 16 and 17, the leg extension unit 23*a* is driven by the electric actuation unit 4 to extend forward, thereby driving the linkage link to move forward, and further driving the backrest connector 241 to flip, causing the seventh pivot point G on the backrest connector 241 to move forward. In this case, since the position of the backrest pivot point M relative to the transmission link is remained unchanged, the backrest bracket 22*a* is driven by the backrest connector 241 to flip backward around the backrest pivot point M. At the same time, the eleventh pivot point L on the backrest connector 241 also moves forward. Since one end of the second auxiliary link 37 is pivotally connected to the transmission link whose position is fixed, and in this example, it is connected to the second sub-piece 342 of the transmission link, thereby pushing the auxiliary pivot point N between the first auxiliary link 36 and the second auxiliary link 37 to move downward, causing the end with auxiliary bush 37*a* of the second auxiliary link 37 to pivot downward around the pivot point, of the second auxiliary link 37, on the second sub-piece 342 of the transmission link, until the auxiliary bushing 37*a* abuts against the base 1, preferably against the Ground bracket 13. In this example, the auxiliary bush 37*a* prevents the reclining apparatus 2 from swinging backward in the lying position to achieve additional support for the backrest bracket in the lying position, thereby preventing the danger of falling over due to excessive back reclining in the lying position, to ensure the safety of the use of the seat unit.

The present disclosure provides a mechanical extension apparatus for an extendable chair unit, the mechanical extension apparatus comprises a reclining apparatus, where the reclining apparatus comprises a multi-link mechanism and is used for attaching to a seat part, a backrest and a footrest of the chair unit, configured to be able to realize a conversion between two end positions of the chair unit, that is, conversion between a sitting position and a lying position, where in the sitting position, the footrest is folded below the seat part; and in the lying position, the backrest is tilted backward and the footrest extends forward to the front of the seat part.

According to the present disclosure, the reclining apparatus is configured such that the conversion between the sitting position and the lying position of the chair unit is realized by an electric actuation unit, where when the chair unit is converted from the sitting position to the lying position, the footrest extends forward to the front of the seat part at the same time as the backrest is tilted backward, and when the chair unit is converted from the lying position to the sitting position, the footrest is folded below the seat part at the same time as the backrest is tilted forward.

The disclosure is based on the idea that the extendable chair unit can be converted between only two end positions, that is, between the sitting position and the lying position, which are the most commonly used by users, and the position change of the backrest is performed at the same time of the position change of the footrest. On the one hand, the rarely used seat postures are discarded, making the structure design simpler and the manufacturing cost lower. On the other hand, users can obtain the desired seat posture in the most convenient way. In addition, the conversion between the two end positions is completed by an electric actuation unit, so that the user can operate the chair unit with effortlessly.

In an example of the present disclosure, the reclining apparatus comprises a leg extension device for mounting a footrest, a seat bracket for mounting a seat part, and a backrest bracket for mounting a backrest, which are pivotally connected in sequence.

In an example of the present disclosure, the mechanical extension apparatus comprises a support assembly for directly or indirectly supporting on the ground, and preferably for providing a swing or rocking function for the chair unit.

In an example of the present disclosure, when the reclining apparatus is configured to be used for a swing, gliding or rocking type chair unit, the chair unit in the sitting position is allowed to swing, glide or rock back and forth relative to the ground, while in the lying position the chair unit is not allowed to swing, glide or rock back and forth relative to the ground. To realize this, the reclining apparatus comprises a swing limit mechanism, which is designed to allow the chair unit in the sitting position to swing back and forth relative to the ground, and prevent the chair unit in the lying position from swinging back and forth relative to the ground.

The leg extension unit is connected with a front crossbar, and the seat bracket is fixedly connected with a rear crossbar, where the front crossbar can be moved forward relative to the rear crossbar by the electric actuation unit, causing the footrest to move to the front of the seat part.

In an example of the present disclosure, the rear crossbar is directly or indirectly fixedly or rigidly connected to the seat bracket.

In an example of the present disclosure, the reclining apparatus further comprises a linkage device for linking the leg extension unit with the backrest bracket, and the linkage device is pivotally connected to the backrest bracket and the leg extension unit, so that at the same time as the leg extension unit extends forward, the backrest bracket can be turned backward around the backrest pivot point where the pivotal connection between the backrest bracket and the seat bracket is located, and at the same time as the leg extension unit is folded backward, the backrest bracket can be turned forward around the backrest pivot point.

In one example, the linkage device at least comprises a one-piece linkage link, and the linkage link is pivotally connected to the backrest bracket on the one hand and pivotally connected to the leg extension unit on the other hand, so as to realize a synchronous movement of the backrest bracket and the leg extension unit. In this embodiment, the linkage link is directly pivotally connected to the backrest bracket at one end, and pivotally connected to the leg extension unit at the other end, preferably pivotally connected to a foot rod of the leg extension unit that is closest to the seat bracket.

In this example, optionally, to achieve structural stability, in addition to a linkage link, the linkage device further comprises a backrest connector, where an upper end of the backrest connector is pivotally connected with a pivot point of the backrest bracket that is behind the backrest pivot point, a lower end of the backrest connector is pivotally connected with the rear end of the linkage link, and the linkage link, and a front end of the linkage link is pivotally connected with the leg extension unit, preferably with the foot rod of the leg extension unit that is closest to the seat bracket. In this case, it can be realized that, by a simple linkage device, the backrest bracket is turned backward and the leg extension unit is extended forward synchronously, and the backrest bracket is turned forward and the leg extension unit is folded backward synchronously, so that the conversion of the chair unit between the sitting position and the lying position can be achieved in a simple and reliable manner.

In order to better realize the conversion of the chair unit between the sitting position and the lying position, further optionally, the support assembly comprises a transmission link fixedly connected to the seat bracket, where a support link is provided between the transmission link and the seat bracket, one end of the support link is connected, optionally fixedly, or pivotally, connected with the transmission link, and another end is connected fixedly with the seat bracket, to fix the relative positions of transmission link and the seat bracket. With this design, during the position conversion of the chair unit, the position of the seat bracket relative to the support assembly can be maintained to be stable particularly effectively, thereby ensuring the pivotal connection point between the seat bracket and the backrest bracket to remain unchanged, which is equivalent to ensuring the position backrest pivot point to remain changed relative to the support assembly, which facilitates the backrest bracket to turn forward or backward around the backrest pivot point under the drive of the backrest connector.

In an example, the mechanical extension apparatus comprises an electric actuation unit, which is preferably a linear motor unit, and components of the electric actuation unit are connected to the front crossbar and the rear crossbar, respectively.

Optionally in this example, it is preferable that the linear motor unit comprises a motor head, a motor slide rail connected to the motor head, and a motor slider slidable relative to the motor slide rail. One end of the electric actuation unit, for example, the motor head, is pivotally connected to the front crossbar fixedly connected to the leg extension unit, and the other end of the electric actuation unit, for example, the motor slider, is pivotally connected to the rear crossbar fixedly connected to the seat bracket, so that when the motor head moves longitudinally, relative to the motor slider, along the longitudinal axis of the motor slide rail, the front crossbar drives the leg extension unit to extend forward or fold backward, and the chair unit is thereby converted between the sitting position and the lying position. Of course, a reverse manner can also be adopted. For example, the motor slider of the electric actuation unit is pivotally connected to the front crossbar fixedly connected to the leg extension unit, and the motor head of the electric actuation unit is pivotally connected to the rear crossbar fixedly connected to the seat bracket.

The mechanical extension apparatus may further comprise a base to provide direct support on the ground, and the support assembly is fixedly supported on the base. The base may be a circular bracket supported on the ground, and a fixed bracket composed of a set of parallel extending support rods is rotatably connected to the circular bracket, so that the chair unit may have rotation function in addition to tilt function and swing/glide/rock function. As an alternative, the base may also be simply configured as a set of parallel-extending ground-contact support brackets that are directly supported on the ground.

Optionally, the support assembly comprises a mounting swing base plate, a front swing rod, a rear swing rod, and a transmission link, where a bottom part of the swing base plate is mounted on the base, and a front end of the swing base plate is pivotally connected to a top end of the front swing rod, a rear end of the swing base plate is pivotally connected to a top end of the rear swing rod, and the transmission link is pivotally connected with a lower end of the front swing rod and a lower end of the rear swing rod.

In addition, the present disclosure also relates to an extendable chair unit. The chair unit comprises: a base for supporting on the ground, a seat part located above the base, a backrest located behind the seat part, a footrest located in front of the seat part or below the seat part, and the aforementioned mechanical extension apparatus. The extendable chair unit may be an extendable swing chair, an extendable rocking chair, a sofa with a swing, gliding or rocking function, and the like.

The present disclosure may include dedicated hardware implementations such as application specific integrated circuits and other hardware devices. The hardware implementations can be constructed to implement one or more of the methods described herein. Examples that may include the apparatus and systems of various implementations can broadly include a variety of mechanical systems. One or more examples described herein may implement functions using two or more specific interconnected hardware devices or units with related control and data signals that can be communicated between and through the units, or as portions of the device. Accordingly, the apparatus or system disclosed may encompass software and hardware implementations. The terms "circuit," "sub-circuit," "unit," or "sub-unit" may include memory (shared, dedicated, or group) that stores code or instructions that can be executed. The unit or circuit may include one or more components that are connected.

The above examples of the present disclosure focus on the differences among various examples, and the different optimization features among the various examples can be combined to form a better example as long as they are not contradictory, which will not be detailed here for brevity concern.

The above-described are only examples of the present disclosure, and are not used to limit the present disclosure. For those skilled in the art, various modifications and variations are possible. Any modification, equivalent substitution, improvement, and others made within the spirit and principle of the present disclosure shall be included within the scope the present disclosure.

What is claimed is:

1. A mechanical extension apparatus, applied to an extendable seat with a seat, a backrest and a footrest, comprising:

a reclining apparatus comprising multiple links attached to the seat, the backrest and the footrest of the extendable seat, wherein the reclining apparatus is configured to convert the extendable seat between a sitting position, a TV position, and a lying position, and wherein, in the sitting position, the backrest is substantially upright and the footrest is folded below the seat; in the TV position, the backrest is substantially upright and the footrest is substantially horizontally disposed in front of the seat; and in the lying position, an angle between the seat and the backrest is generally larger than the angle between the seat and the backrest in the TV position;

a support assembly, wherein the support assembly support the mechanical extension apparatus directly or indirectly on ground, and the support assembly comprises a gliding support assembly or a rocking support assembly;

a leg extension unit for mounting the footrest, a seat bracket for mounting the seat, and a backrest bracket for mounting the backrest, wherein the leg extension unit, the seat bracket, and the backrest bracket are pivotally connected in sequence;

a pull link, wherein a rear end of the pull link is pivotally connected to the backrest bracket in front of a pivot connection point between the seat bracket and the backrest bracket, a front end of the pull link is pivotally connected to the support assembly; and an actuator that is attached to the reclining apparatus, wherein the actuator is configured to electronically convert the extendable seat between the sitting position and the TV position; and wherein the reclining apparatus is configured to convert the extendable seat between the TV position and the lying position by non-electric actuation.

2. The mechanical extension apparatus of claim 1, wherein the non-electric actuation of the reclining apparatus configured to convert the extendable seat between the TV position and the lying position comprises: manual actuation, hydraulic actuation, pneumatic actuation or spring actuation.

3. The mechanical extension apparatus of claim 1, further comprising a swing limit, wherein the swing limit is configured to allow the extendable seat to glide or rock back and forth in the sitting position, and the swing limit is configured to prevent the extendable seat from gliding or rocking in the TV position and in the lying position.

4. The mechanical extension apparatus of claim 1, wherein the leg extension unit is connected with a front crossbar, and the seat bracket is fixedly connected with a rear crossbar, wherein the front crossbar is configured to move forward relative to the rear crossbar by the actuator, to move the footrest to the front of the seat.

5. The mechanical extension apparatus of claim 4, wherein the rear crossbar is directly or indirectly connected to the seat bracket, or the rear crossbar is fixedly or rigidly connected to the seat bracket.

6. The mechanical extension apparatus of claim 1, wherein middle of the pull link is pivotally connected to the seat bracket.

7. The mechanical extension apparatus of claim 4, wherein the actuator is a linear actuator, and the linear actuator is connected to the front crossbar and the rear crossbar.

8. The mechanical extension apparatus of claim 1, wherein the backrest bracket is configured to recline around a backrest pivot point connected to the seat bracket when a user moves a center of gravity and presses against the backrest, such that the seat bracket rises during reclining of the backrest bracket; and when the user moves the center of gravity to release force pressing against the backrest, the backrest bracket is configured to turn generally upright around the backrest pivot point.

9. The mechanical extension apparatus of claim 6, further comprising:

a pull link, and a spring connecting the pull link and the seat bracket, wherein the spring is configured to provide a downward pulling force to the pull link when the backrest bracket turns forward, to assist the backrest to convert back to the sitting position; the downward pulling force of the spring exerted on the pull link is located behind a connecting point of the pull link and the seat bracket.

10. The mechanical extension apparatus of claim 8, further comprising:

a pneumatic spring, connected to the backrest pivot point of the backrest bracket, wherein the pneumatic spring is configured to support the backrest bracket to flip forward around the backrest pivot point when the user gets up.

11. The mechanical extension apparatus of claim 1, further comprising:

a backrest locking mechanism, wherein backrest locking mechanism is configured to prevent the backrest from reclining in the sitting position, and to prevent the backrest from reclining beyond a maximum reclining degree in the lying position.

12. The mechanical extension apparatus of claim 1, further comprising a base, wherein the base directly supports the extendable seat on the ground, and the support assembly is fixedly attached on the base.

13. The mechanical extension apparatus of claim 1, wherein an angle between the seat and the backrest of the extendable seat is larger than 90 degrees in the TV position, and the angle between the seat and the backrest in the lying position is larger than the angle between the seat and the backrest in the TV position.

14. An extendable seat, comprising:

a base;

a seat disposed on the base;

a backrest disposed on a back side of the seat;

a footrest disposed on a front side of the seat; and a mechanical extension apparatus, comprising:

a reclining apparatus comprising multiple links attached to the seat, the backrest and the footrest of the extendable seat, wherein the reclining apparatus is configured to convert the extendable seat between a sitting position, a TV position, and a lying position, and wherein, in the sitting position, the backrest is substantially upright and the footrest is folded below the seat; in the TV position, the backrest is substantially upright and the footrest is substantially horizontally disposed in front of the seat; and in the lying position, an angle between the seat and the backrest is generally larger than the angle between the seat and the backrest in the TV position;

a support assembly, wherein the support assembly support the mechanical extension apparatus directly or indirectly on ground, and the support assembly comprises a gliding support assembly or a rocking support assembly;

a leg extension unit for mounting the footrest, a seat bracket for mounting the seat, and a backrest bracket for mounting the backrest, wherein the leg extension unit, the seat bracket, and the backrest bracket are pivotally connected in sequence;

a pull link, wherein a rear end of the pull link is pivotally connected to the backrest bracket in front of a pivot connection point between the seat bracket and the backrest bracket, a front end of the pull link is pivotally connected to the support assembly; and an actuator that is attached to the reclining apparatus and the actuator is configured to electronically convert the extendable seat between the sitting position and the TV position; and wherein the reclining apparatus is configured to convert the extendable seat between the TV position and the lying position by non-electric actuation.

15. The extendable seat of claim 14, wherein the non-electric actuation of the reclining apparatus configured to convert the extendable seat between the TV position and the lying position comprises: manual actuation, hydraulic actuation, pneumatic actuation or spring actuation.

16. The extendable seat of claim 14, further comprising:

a swing limit, wherein the swing limit is configured to allow the extendable seat to glide or rock back and forth in the sitting position, and the swing limit is configured to prevent the extendable seat from gliding or rocking in the TV position and in the lying position.

17. The extendable seat of claim 14, further comprising:

a backrest locking mechanism, wherein backrest locking mechanism is configured to prevent the backrest from reclining in the sitting position, and to prevent the backrest from reclining beyond a maximum reclining degree in the lying position.

18. The extendable seat of claim 14, wherein an angle between the seat and the backrest of the extendable seat is larger than 90 degrees in the TV position, and the angle between the seat and the backrest in the lying position is larger than the angle between the seat and the backrest in the TV position.

* * * * *